United States Patent [19]

Yagihara et al.

[11] Patent Number: 4,737,442

[45] Date of Patent: Apr. 12, 1988

[54] SILVER HALIDE PHOTOGRAPHIC MATERIAL AND SUPER-HIGH CONTRAST NEGATIVE IMAGE FORMATION PROCESS USING THE SAME

[75] Inventors: Morio Yagihara; Tetunori Matusita; Nobuaki Inoue, all of Kanagawa, Japan

[73] Assignee: Fuji Photo Film Co., Ltd., Kanagawa, Japan

[21] Appl. No.: 853,815

[22] Filed: Apr. 18, 1986

[30] Foreign Application Priority Data

Apr. 18, 1985 [JP] Japan ..... 60-83256

[51] Int. Cl.[4] ..... G03C 1/10; G03C 1/33

[52] U.S. Cl. ..... 430/264; 430/448; 430/446; 430/267; 430/957; 430/949; 430/599; 430/600; 430/564

[58] Field of Search ..... 430/264, 267, 957, 949, 430/446, 448, 599, 600, 564

[56] References Cited

U.S. PATENT DOCUMENTS 4,332,878 6/1982 Akimura et al. ..... 430/264

4,345,024 8/1982 Hirano et al. ..... 430/957

4,500,636 2/1985 Ono et al. ..... 430/957

4,518,685 5/1985 Yagihara et al. ..... 430/957

4,636,456 1/1987 Takahashi et al. ..... 430/267

*Primary Examiner*—Won H. Louie

*Attorney, Agent, or Firm*—Sughrue, Mion, Zinn, Macpeak & Seas

[57] ABSTRACT

A silver halide photographic material for use in the field of graphic arts and a process for forming a high-contrast negative image using the same, wherein the silver halide emulsion layer or another layer of the silver halide photographic material provided on the support contains at least one compound represented by the formula (I) and at least one blocked development restrainer compound represented by the formula (II):

(I)

$$C_A-D. \quad \text{(II)}$$

12 Claims, No Drawings

SILVER HALIDE PHOTOGRAPHIC MATERIAL AND SUPER-HIGH CONTRAST NEGATIVE IMAGE FORMATION PROCESS USING THE SAME

FIELD OF THE INVENTION

This invention relates to a silver halide photographic material for use in the field of graphic arts and a process for forming a super-high contrast negative image by using the same.

BACKGROUND OF THE INVENTION

In the field of graphic arts, an image-formation system providing a super-high contrast photographic characteristic, especially a gamma of 10 or more, is required for satisfactory reproduction of continuous tone images or line images by dot images. For this purpose, a specific developer called a lith developer is generally used. The lith developer contains, as a developing agent, hydroquinone and, as a preservative, a sulfite in the form of an adduct with formaldehyde so as to control the free sulfite ion at an extremely low level, usually not more than 0.1 mol/l, thereby preventing deterioration of the infectious development ability of the developing agent. The lith developer has a serious disadvantage in that it is very susceptible to air oxidation and cannot withstand use for a long period of time exceeding 3 days.

Known processes for obtaining high contrast photographic characteristics with a stable developer include the process of using hydrazine derivatives as described in U.S. Pat. Nos. 4,224,401, 4,168,977, 4,166,742, 4,311,781, 4,272,606, 4,211,857 and 4,243,739, etc. This process provides super-high contrast and high sensitivity, and also ensures greatly improved stability of the developer against air oxidation as compared to the conventional lith developer because of the high permissible sulfite ion concentration in the developer.

However, it has been found that the image formation system employing the hydrazine derivatives tends to cause black spots called black pepper on non-image area, for example, between dots. This phenomenon becomes particularly conspicuous when the sulfite ion content in a developer is decreased or the pH of a developer increases due to fatigue of the developer, and causes significant impairment of photographic quality.

Various attempts have hitherto been made in order to eliminate the problem of black spots, but ad hoc improvement frequently accompanies reduction in sensitivity and gamma. In particular, no means has been proposed for solving the problem of black spots without hindering the effect of the above-described hydrazine compounds to increase sensitivity and contrast.

SUMMARY OF THE INVENTION

Accordingly, an object of this invention is to provide a highly sensitive silver halide photographic material which can be developed with a stable developer to obtain a super-high contrast image and a process for forming a super-high contrast negative image using such a material.

Another object of this invention is to provide a silver halide photographic material which is free from black spots and a process for forming a super-high contrast negative image using such a material.

The above objects can be accomplished by a silver halide photographic material comprising a support having provided thereon at least one silver halide emulsion layer, wherein said emulsion layer or another layer of the silver halide photographic material provided on the support contains at least one compound represented by the following formula (I) and at least one blocked development restrainer represented by the following formula (II), and a process for forming a super-high contrast negative image comprising imagewise exposing the above-described photographic material to light and developing the exposed material with a developer containing not less than 0.15 mol/l of a sulfite ion and having a pH of from 10.5 to 12.3.

$$A-\underset{\underset{R_0}{|}}{N}-\underset{\underset{R_1}{|}}{N}-B \qquad (I)$$

wherein A represents an aliphatic group or an aromatic group; B represents a formyl group, an acyl group, an alkyl- or arylsulfonyl group, an alkyl- or arylsulfinyl group, a carbamoyl group, an alkoxy- or aryloxycarbonyl group, a sulfinamoyl group, an alkoxysulfonyl group, a thioacyl group, a thiocarbamoyl group or a heterocyclic group; $R_0$ and $R_1$ each represents a hydrogen atom, a substituted or unsubstituted alkylsulfonyl group, a substituted or unsubstituted arylsulfonyl group or a substituted or unsubstituted acyl group, with the proviso that at least one of $R_0$ and $R_1$ is a hydrogen atom; and B, $R_1$ and the nitrogen atom to which B and $R_1$ are bonded may jointly form $-N=C<$ (a partial structure of hydrazone).

$$C_A-D \qquad (II)$$

wherein $C_A$ represents a blocking group capable of releasing a development restrainer or a precursor thereof at the time of development processing regardless of the exposure amount; and D represents a development restrainer or a precursor thereof that is bonded to $C_A$ via a hetero atom of D.

DETAILED DESCRIPTION OF THE INVENTION

The compound represented by the formula (II) according to the present invention remarkably reduces or eliminates black spots without inhibiting the effect of the compound represented by the formula (I) to increase sensitivity and contrast.

The compound of the formula (I) and the compound of the formula (II) are preferably incorporated into the same layer, but may also be incorporated into different layers.

In the above-described formula (I), the aliphatic group represented by A preferably contains from 1 to 30 carbon atoms, and more preferably includes a substituted or unsubstituted straight or branched chain or cyclic alkyl group having from 1 to 20 carbon atoms. The branched chain alkyl group may be cyclized so as to contain a saturated hetero ring containing at least one hetero atom. The substituents for the substituted alkyl group includes an aryl group, an alkoxy group, a sulfoxy group, a sulfonamido group, a carboxyamido group, etc.

Specific examples of the aliphatic group as represented by A includes a t-butyl group, an n-octyl group, a t-octyl group, a cyclohexyl group, a pyrrolidyl group, an imidazolyl group, a tetrahydrofuryl group, a morpholino group, and the like.

The aromatic group as represented by A is a substituted or unsubstituted monocyclic or dicyclic aryl group or a substituted or unsubstituted unsaturated heterocyclic group. The unsaturated heterocyclic group may be condensed with a monocyclic or dicyclic aryl group to form a heteroaryl group.

Specific examples of the aromatic group as represented by A include a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, with those containing a benzene ring being preferred.

Substituents for the substituted aryl or unsaturated heterocyclic groups as represented by A typically include a straight or branched chain or cyclic alkyl group, preferably having from 1 to 20 carbon atoms, an aralkyl group, preferably a monocyclic or dicyclic aralkyl group having from 1 to 3 carbon atoms in its alkyl moiety; an alkoxy group, preferably having from 1 to 20 carbon atoms; a substituted amino group, preferably substituted with an alkyl group having from 1 to 20 carbon atoms; an acylamino group, preferably having from 2 to 30 carbon atoms; a sulfonamido group, preferably having from 1 to 30 carbon atoms; an ureido group, preferably having from 1 to 30 carbon atoms; and the like.

The most preferred among these groups as represented by A is an aryl group.

The group is represented by A may have incorporated therein a ballast group that is commonly employed in immobile photographic additives, such as couplers. A ballast group is relatively inert to photographic properties and contains 8 or more carbon atoms and can be selected from, for example, an alkyl group, an alkoxy group, a phenyl group, an alkylphenyl group, a phenoxy group, an alkylphenoxy group, and the like.

The group as represented by A may also have incorporated therein a group which enhances adsorption to surfaces of silver halide grains. Such an adsorptive group includes those described in U.S. Pat. Nos. 4,385,108 and 4,459,347, Japanese Patent Application (OPI) Nos. 195233/84, 200231/84, 201045/84, 201046/84, 201047/84, 201048/84 and 201049/84 (the term "OPI" as used herein refers to a "published unexamined Japanese patent application"), Japanese Patent Application No. 36788/84 (corresponding to Japanese Patent Application (OPI) No. 179734/85), Japanese Patent Application Nos. 11459/85 (Japanese Patent Application (OPI) No. 170733/86) and 19739/85 (Japanese Patent Application (OPI) No. 948/87), etc., such as a thiourea group, a heterocyclic thioamido group, a mercapto heterocyclic group, a triazole group, and the like. Example of the heterocyclic moiety in the adsorptive group includes a pyrimidine ring, a triazine ring, a pyridine ring, a quinoline ring, a benzimidazole ring, a benzothiazole ring, a benzoxazole ring, an imidazoline ring, etc.

In the above-described formula (I), B specifically represents a formyl group, an acyl group (e.g., an acetyl group, a propionyl group, a trifluoroacetyl group, a chloroacetyl group, a benzoyl group, a 4-chlorobenzoyl group, a pyruvoyl group, a methoxalyl group, a methyloxamoyl group, etc.), an alkylsulfonyl group (e.g., a methanesulfonyl group, a 2-chloroethanesulfonyl group, etc.), an arylsulfonyl group (e.g., a benzenesulfonyl group, etc.), an alkylsulfinyl group (e.g., a methanesulfinyl group, etc.), an arylsulfinyl group (e.g., a benzenesulfinyl group, etc.), a carbamoyl group (e.g., a methylcarbamoyl group, a phenylcarbamoyl group, etc.), a sulfamoyl group (e.g., a dimethylsulfamoyl group, etc.), an alkoxycarbonyl group (e.g., a methoxycarbonyl group, a methoxyethoxycarbonyl group, etc.), an aryloxycarbonyl group (e.g., a phenoxycarbonyl group, etc.), a sulfinamoyl group (e.g., a methylsulfinamoyl group, etc.), a alkoxysulfonyl group (e.g., a methoxysulfonyl group, an ethoxysulfonyl group, etc.), a thioacyl group (e.g., a methylthiocarbonyl group, etc.), a thiocarbamoyl group (e.g., a methylthiocarbamoyl group, etc.) or a heterocyclic group (e.g., a pyrimidine ring, a triazine ring, a pyridine ring, a quinoline ring, a benzimidazole ring, a benzothiazole ring, a benzoxazole ring, an imidazoline ring, etc.).

The most preferred among these groups as represented by B are a formyl group and an acyl group.

The group as represented by B may be taken together with $R_1$ and the nitrogen atom to which B and $R_1$ are bonded to form

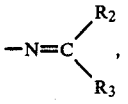

a partial structure of hydrazone, wherein $R_2$ represents an alkyl group, an aryl group or a heterocyclic group; and $R_3$ represents a hydrogen atom, an alkyl group, an aryl group or a heterocyclic group. Examples of the heterocyclic group represented by $R_3$ includes a pyrimidine ring, a triazine ring, a pyridine ring, a quinoline ring, a benzimidazole ring, a benzothiazole ring, a benzoxazole ring, an imidazoline ring, etc.

$R_0$ and $R_1$ each represents a hydrogen atom; an alkyl- or arylsulfonyl group, preferably having up to 20 carbon atoms and more preferably a phenylsulfonyl group or a substituted phenylsulfonyl group having a total Hammett's substituent constant of −0.5 or more; or an acyl group, preferably having up to 20 carbon atoms and more preferably a benzoyl group, a substituted benzoyl group having a total Hammett's substituent constant of −0.5 or more or a substituted or unsubstituted straight or branched chain or cyclic aliphatic acyl group, the substituent including, for example, a halogen atom, an ether group, a sulfonamido group, a carbonamido group, a hydroxyl group, a carboxyl group, a sulfonic acid group, etc.

The most preferred among these groups as represented by $R_0$ or $R_1$ is a hydrogen atom.

Specific but non-limiting examples of the compounds represented by the formula (I) are shown below:

I-1

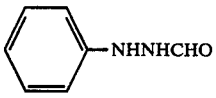

I-2

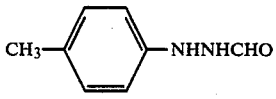

-continued
I-3
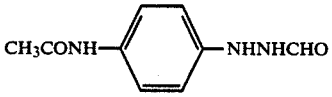
I-4
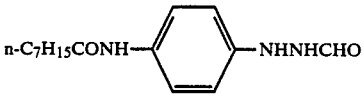
I-5
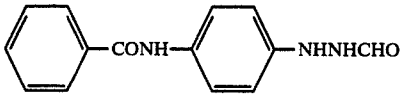
I-6
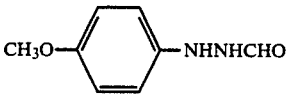
I-7
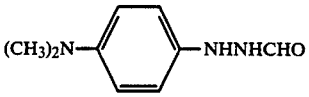
I-8
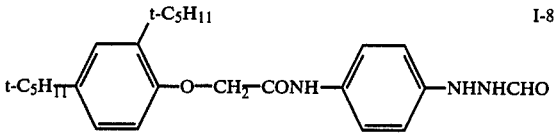
I-9
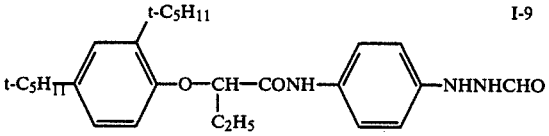
I-10
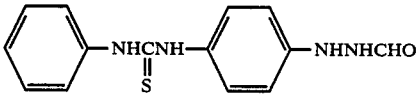
I-11
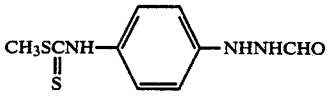
I-12
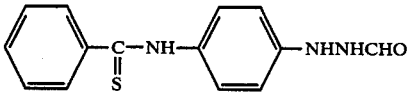
I-13
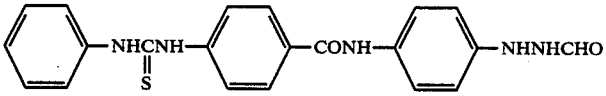
I-14
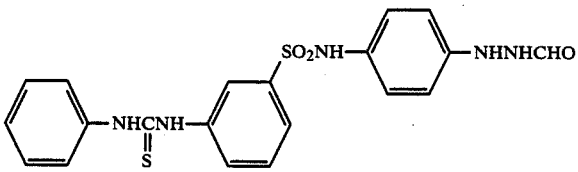
I-15
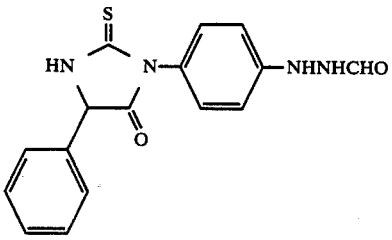
I-16
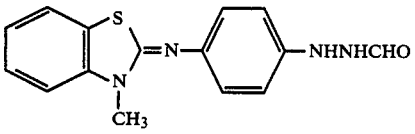
I-17
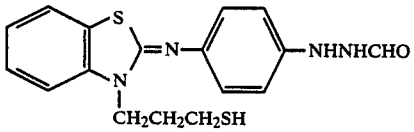
I-18
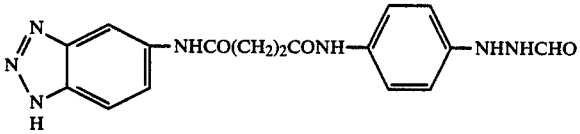
I-19
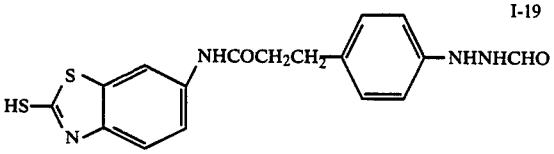
I-20
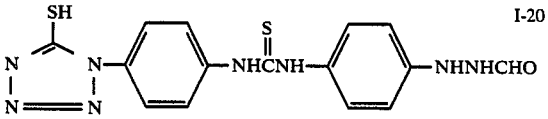

-continued
I-21
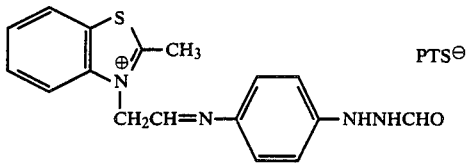
I-22
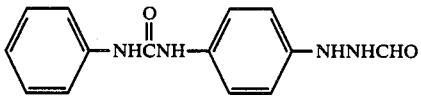
I-23
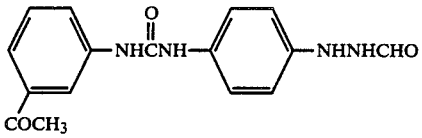
I-24
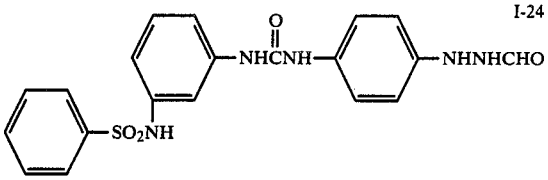
I-25
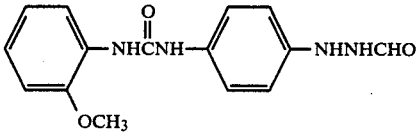
I-26
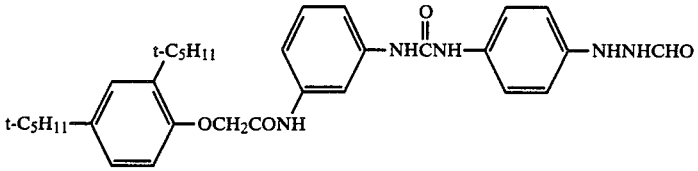
I-27
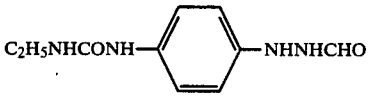
I-28
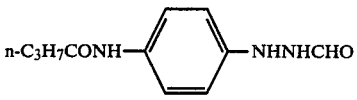
I-29
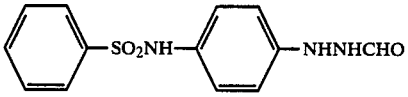
I-30
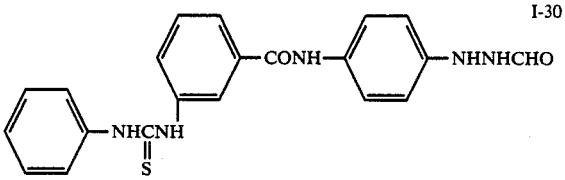
I-31
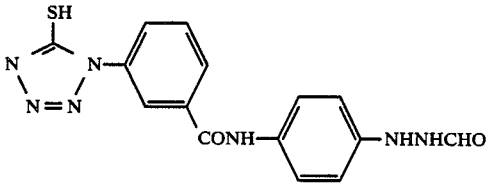
I-32
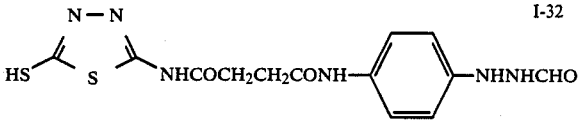
I-33
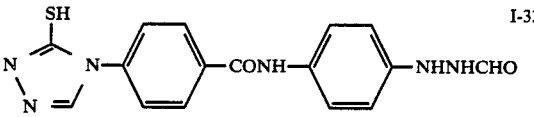
I-34
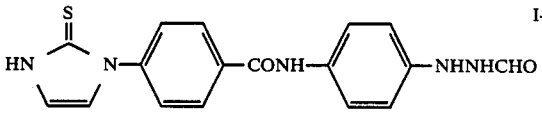
I-35
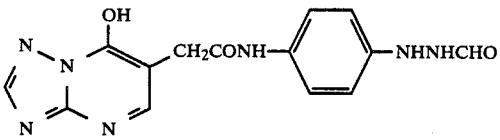
I-36
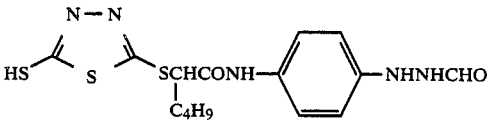

-continued
I-37
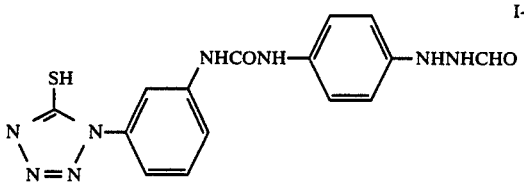
I-38
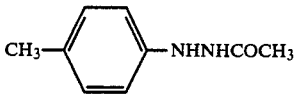
I-40
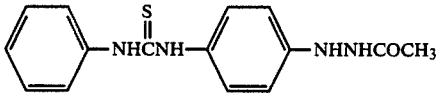
I-41
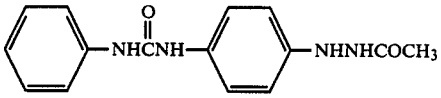
I-42
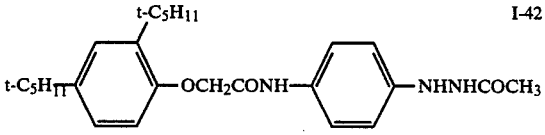
I-43
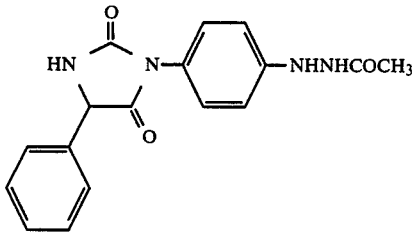
I-44
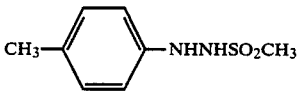
I-45
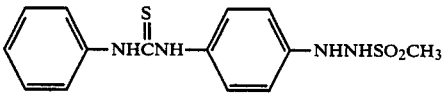
I-46
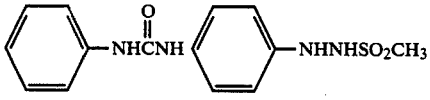
I-47
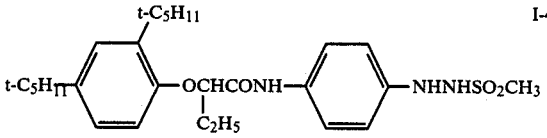
I-48
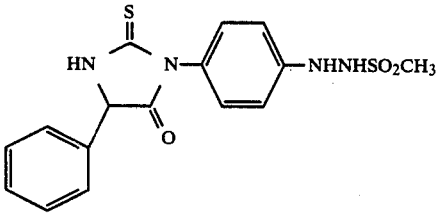
I-49
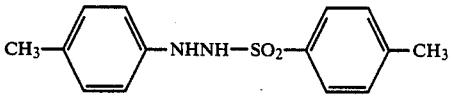
I-50
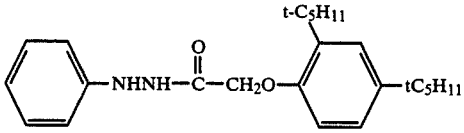
I-51
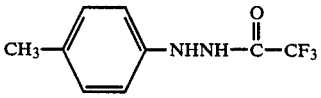
I-52
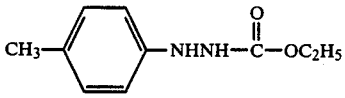
I-53
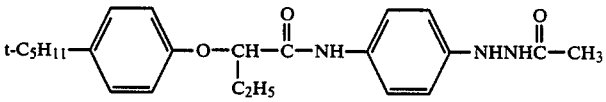
I-54
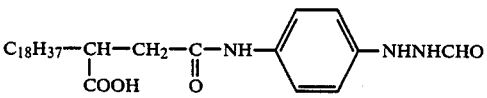

-continued
I-55
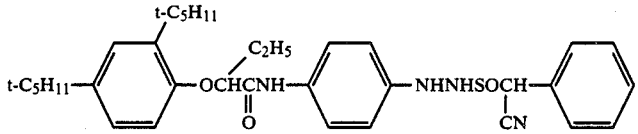
I-56
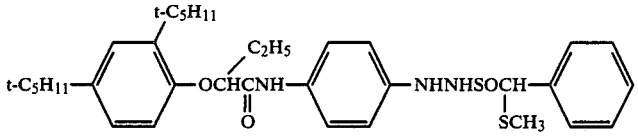
I-57
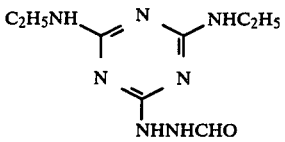
I-58
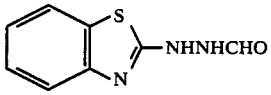
I-59
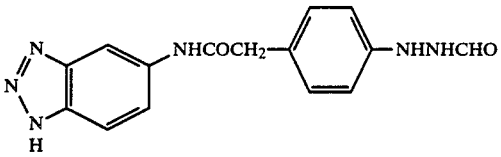
I-60
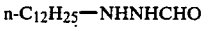
I-61
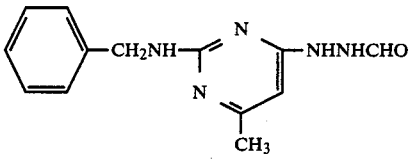
I-62
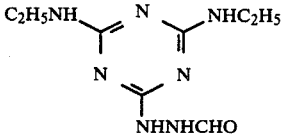
I-63
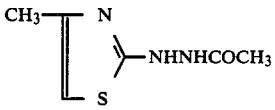
I-64
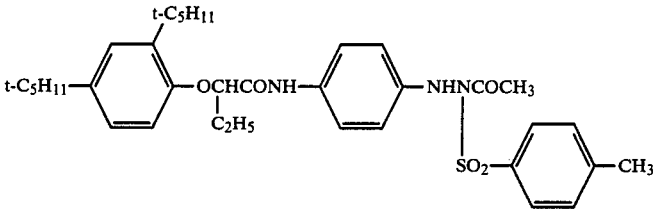
I-65
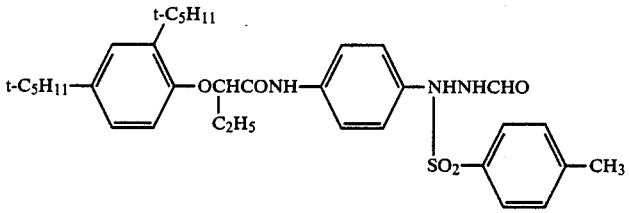
I-66
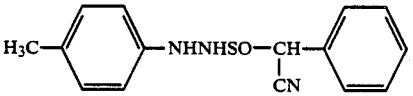
I-67
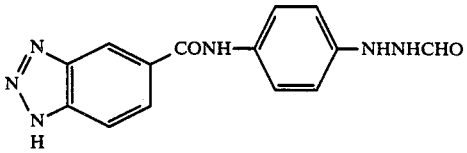

-continued

I-68

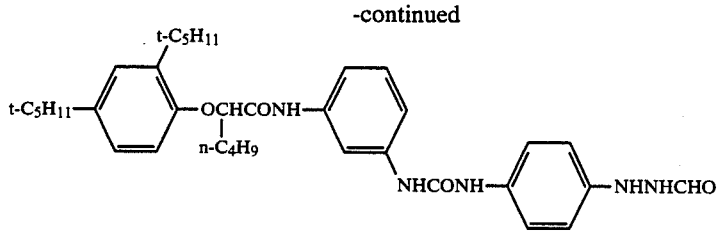

I-69

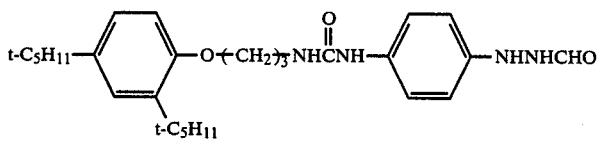

I-70

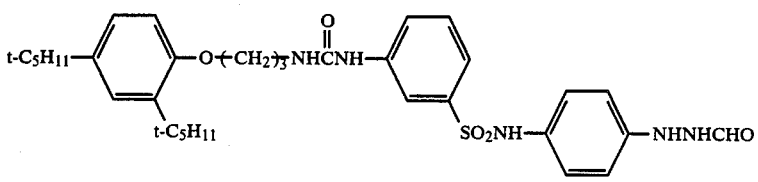

I-71

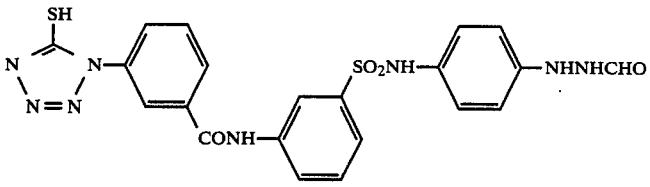

I-72

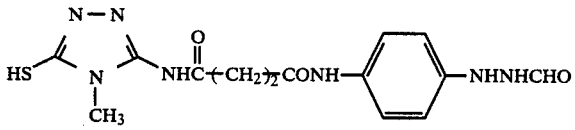

I-73

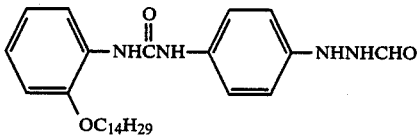

I-74

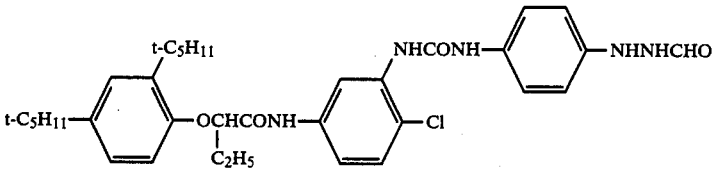

In the above-described formula (II), the blocking group represented by $C_A$ is conventionally known and includes, for example, blocking groups such as an acyl group, a sulfonyl group, etc., as described in Japanese Patent Publication No. 9968/73, Japanese Patent Application (OPI) Nos. 8828/77 and 82834/82, and U.S. Pat. No. 3,311,476 and Japanese Patent Publication No. 44805/72 (corresponding to U.S. Pat. No. 3,615,617; blocking groups capable of releasing a development restrainer upon the so-called reverse Michael reaction as described in Japanese Patent Publication Nos. 17369/80, 9696/80 and 34927/80 (corresponding to U.S. Pat. Nos. 3,888,677, 3,791,830 and 4,009,029, respectively), Japanese Patent Application (OPI) No. 77842/81 (corresponding to U.S. Pat. No. 4,307,175), and Japanese Patent Application (OPI) Nos. 105642/84 and 105640/84; blocking groups capable of releasing a development restrainer with formation of a quinomethide or an analogue thereof by intramolecular electron transfer as described in Japanese Patent Publication No. 39727/79, U.S. Pat. Nos. 3,674,478, 3,932,480 and 3,996,661, and Japanese Patent Application (OPI) Nos. 135944/82, 135945/82 and 136640/82; blocking groups utilizing an intramolecular cyclization reaction as described in Japanese Patent Application (OPI) Nos. 53330/80 and 218439/84; blocking groups utilizing ring cleavage of a 5- or 6-membered ring as described in Japanese Patent Application (OPI) No. 76541/82 (corresponding to U.S. Pat. No. 4,335,220), Japanese Patent Application (OPI) Nos. 135949/82, 179842/82, 137945/84, 140445/84, 219741/84 and 41034/85; blocking groups capable of releasing a development restrainer by addition of a nucleophilic reagent onto an unsaturated bond as described in Japanese Patent Application (OPI) No. 201057/84 and Japanese Patent Application Nos. 145593/84, 216926/84 and 216928/84; and the like.

The compounds of the formula (II) are preferably represented by the formula (III):

$$C_A-(X)_{m1}-E \quad \text{(III)}$$

wherein E represents a development restrainer that is bonded to X via a hetero atom of E; X represents a divalent linking group that is bonded to $C_A$ via a hetero atom of X; and $m_1$ represents 0 or 1.

The development restrainer moiety represented by E is a known group carrying a hetero atom, via which E bonds to X. Examples of such groups are described in, e.g., C. E. K. Mees and T. H. James, *The Theory of Photographic Processes*, 3rd Ed., 344–346, Macmillan (1966). Specific examples include mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, and the like.

Typical examples of the development restrainers which can be used in the present invention are shown below:

1. Mercaptotetrazole Derivatives (1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-Naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole hydrochloride
(32) 1-(2-Diethylaminoethyl)-5-mercaptotetrazole
(33) 2-(5-Mercapto-1-tetrazolyl)ethyltrimethylammonium chloride 2. Mercaptotriazole Derivatives (1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-Naphthyl)-3-mercaptotriazole 3. Mercaptoimidazole Derivatives (1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole 4. Mercaptopyrimidine Derivatives (1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole Derivatives (1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthoimidazole
(8) 2-Mercapto5-sulfobenzimidazole
(9) 1-(2-Hydroxyethyl)-2-mercaptobenzimidazole
(10) 5-Caproamido-2-mercaptobenzimidazole
(11) 5-(2-Ethylhexanoylamino)-2-mercaptobenzimidazole 6. Mercaptothiadiazole Derivatives (1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole 7. Mercaptobenzothiazole Derivatives (1) 2-Mercaptobenzothiazole
(2) 5-Nitro-2-mercaptobenzothiazole
(3) 5-Carboxy-2-mercaptobenzothiazole 8. Mercaptobenzoxazole Derivatives (1) 2-Mercaptobenzoxazole
(2) 5-Nitro-2-mercaptobenzoxazole
(3) 5-Carboxy-2-mercaptobenzoxazole 9. Benzotriazole Derivatives (1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole

(11) 5-Carboxybenzotriazole
(12) 5-Sulfobenzotriazole sodium salt
(13) 5-Methoxycarbonylbenzotriazole
(14) 5-Aminobenzotriazole
(15) 5-Butoxybenzotriazole
(16) 5-Ureidobenzotriazole
(17) Benzotriazole 10. Benzimidazole Derivatives (1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole 11. Indazole Derivatives (1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole The development restrainer moiety represented by E may be bonded to $C_A$ either directly when $m_1$ is 0, via X when $m_1$ is 1.

X represents a divalent linking group which is bonded to E via a hetero atom of X and is capable of being cleaved as part of X-E upon processing and then rapidly releasing E.

Such a linking group includes a group capable of releasing E through intramolecular cyclization as described in Japanese Patent Application (OPI) No. 145135/79 (corresponding to British Patent No. 2,010,818A; a group capable of releasing E through intramolecular electron transfer as described in Japanese Patent Application (OPI) No. 154234/82 (corresponding to U.S. Pat. No. 4,421,845); a group capable of releasing E with the release of carbonic acid gas as described in Japanese Patent Application (OPI) No. 179842/82; a group capable of releasing E with the release of formaldehyde as described in Japanese Patent Application (OPI) No. 93442/84 (corresponding to U.S. Pat. No. 4,522,917); and so on. Structures of typical examples of X are shown below ((E) shows the position where X is bonded to E):

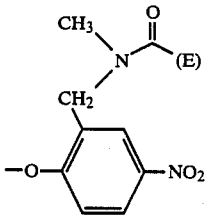

-continued

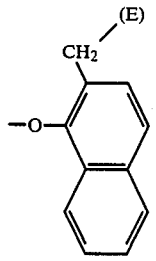

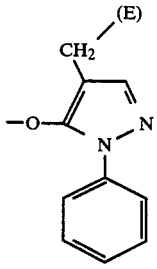

$-O-\underset{\underset{O}{\|}}{C}-(E)$ $-OCH_2-(E)$ $-O-\underset{\underset{O}{\|}}{C}OCH_2-(E)$ The blocked development restrainer which can be used in the present invention is preferably a compound containing at least one group represented by

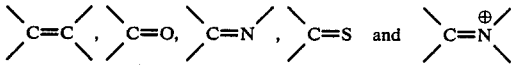

and is capable of releasing a development restrainer upon attachment of a nucleophilic substance, typically an $OH^{\ominus}$ ion, to a carbon atom of such a functional group and the subsequent reaction.

Particularly preferred development restrainers include those represented by the following formulae (IV), (V) and (VI):

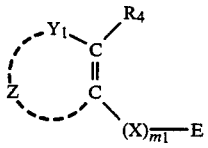

(IV)

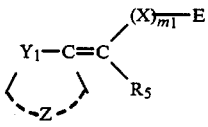

(V)

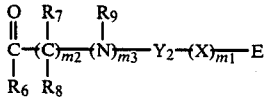

(VI)

In the formula (IV), $R_4$ represents a hydrogen atom or a displaceable group; $Y_1$ represents

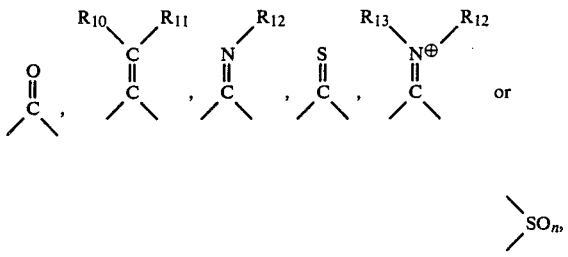

wherein $R_{10}$, $R_{11}$, $R_{12}$ and $R_{13}$ each represents a hydrogen atom, or a displaceable group; n represents 1 or 2; and Z represents an atom group necessary to form a carbon ring or a heterocyclic ring.

X, $m_1$ and E are as defined above with respect to formula (III).

The displaceable group represented by $R_4$, $R_{10}$, $R_{11}$, $R_{12}$ or $R_{13}$ includes a halogen atom, an alkyl group, an alkenyl group, an aryl group, an alkoxy group, an aryloxy group, an alkylthio group, an arylthio group, an acyloxy group, a carbonic acid ester group, an amino group, a carbonamido group, an ureido group, a carboxyl group, a hydroxycarbonyl group, a carbamoyl group, an acyl group, a sulfo group, a sulfonyl group, a sulfinyl group, a sulfamoyl group, a cyano group, a nitro group, etc. More specifically, displaceable groups are a halogen atom (e.g., a fluorine atom, a chlorine atom, a bromine atom, etc.), an alkyl group (preferably having from 1 to 20 carbon atoms), an alkenyl group (preferably having from 2 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an acyloxy group (preferably having from 2 to 20 carbon atoms), a substituted or unsubstituted amino group (preferably a secondary or tertiary amino group substituted with an alkyl group having from 1 to 20 carbon atoms or an aryl group having from 6 to 20 carbon atoms), a carbonamido group (preferably an alkylcarbonamido group having from 1 to 20 atoms or an arylcarbonamido group having from 6 to 20 carbon atoms), an ureido group (preferably and alkylureido group having from 1 to 20 carbon atoms or an arylureido group having from 6 to 20 carbon atoms), a carboxyl group, a carbonic acid ester group (preferably an alkyl carbonate group having from 1 to 20 carbon atoms or an aryl carbonate group having from 6 to 20 carbon atoms), a hydroxycarbonyl group (preferably an alkyloxycarbonyl group having from 1 to 20 carbon atoms or an aryloxycarbonyl group having from 6 to 20 carbon atoms), a carbamoyl group (preferably an alkylcarbamoyl group having from 1 to 20 carbon atoms or an arylcarbamoyl group having from 6 to 20 carbon atoms), an acyl group (preferably an alkylcarbonyl group having from 1 to 20 carbon atoms or an arylcarbonyl group having from 6 to 20 carbon atoms), a sulfo group, a sulfonyl group (preferably an alkylsulfonyl group having from 1 to 20 carbon atoms or an arylsulfonyl group having from 6 to 20 carbon atoms), a sulfinyl group (preferably an alkylsulfinyl group having from 1 to 20 carbon atoms or an arylsulfinyl group having from 6 to 20 carbon atoms), a sulfamoyl group (preferably an alkylsulfamoyl group having from 1 to 20 carbon atoms or an arylsulfamoyl group having from 6 to 20 carbon atoms), a cyano group and a nitro group. The alkyl, alkenyl and aryl groups of these displaceable group may have a substituent selected from the above-enumerated various groups.

Particularly preferred groups for $R_{10}$ and $R_{11}$ are a hydroxycarbonyl group, a carbamoyl group, an acyl group, a sulfonyl group, a sulfinyl group, a sulfamoyl group, a cyano group and a nitro group.

The carbon ring or heterocyclic ring represented by

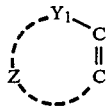

is a 5- to 7-membered carbon ring or a 5- to 7-membered heterocyclic ring containing at least one hetero atom, e.g., a nitrogen atom, an oxygen atom, a sulfur atom, etc. Such a carbon ring or heterocyclic ring may form a condensed ring at an appropriate position thereof.

Specific examples of the above-described carbon ring and heterocyclic ring are cyclopentenone, cyclohexenone, cycloheptenone, benzocycloheptenone, benzocyclopentenone, benzocyclohexenone, 4-pyridone, 4-quinolone, 2-pyrrone, 4-pyrrone, 1-thio-2-pyrrone, 1-thio-4-pyrrone, coumarin, chromone, uracil, etc., and, in addition, the heterocyclic rings shown below:

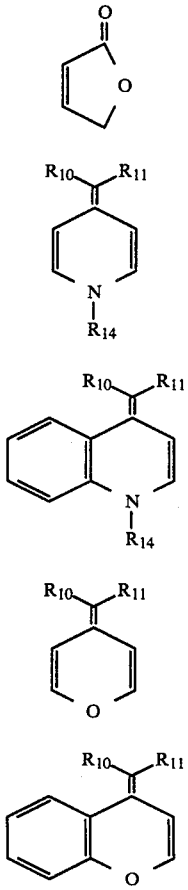

-continued

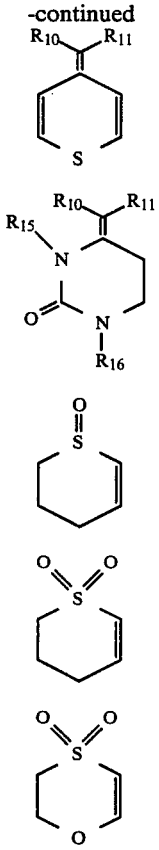

$R_{10}$ and $R_{11}$ are defined below.

$R_{14}$ represents a hydrogen atom or a substituent. $R_{14}$ preferably represents an alkyl group, an alkenyl group or a phenyl group. More preferably, $R_{14}$ represents an alkyl group having from 1 to 18 carbon atoms or a phenyl group having from 6 to 21 carbon atoms.

$R_{15}$ and $R_{16}$ each represents a hydrogen atom, an alkyl group, an alkenyl group, an aryl group, a carbamoyl group, a hydroxycarbonyl group, an acyl group, a sulfonyl group, a sulfinyl group, a sulfamoyl group, etc.

These carbon rings and heterocyclic rings may have one or more substituents, which may be the same or different. Examples of the substituents include a halogen atom (e.g., a fluorine atom, a chlorine atom, a bromine atom, etc.), an alkyl group (preferably having from 1 to 20 carbon atoms), an aryl group (preferably having from 6 to 20 carbon atoms), an alkoxy group (preferably having from 1 to 20 carbon atoms), an aryloxy group (preferably having from 6 to 20 carbon atoms), an alkylthio group (preferably having from 1 to 20 carbon atoms), an arylthio group (preferably having from 6 to 20 carbon atoms), an acyl group (preferably having from 2 to 20 carbon atoms), an acylamino group (preferably an alkanoylamino group having from 1 to 20 carbon atoms or a benzoylamino group having from 6 to 20 carbon atoms), a nitro group, a cyano group, a hydroxycarbonyl group (preferably an alkoxycarbonyl group having from 1 to 20 carbon atoms or an aryloxycarbonyl group having from 6 to 20 carbon atoms), a hydroxyl group, a carboxyl group, a sulfo group, an ureido group (preferably an alkylureido group having from 1 to 20 carbon atoms or an arylureido group having from 6 to 20 carbon atoms), a sulfonamido group (preferably an alkylsulfonamido group having from 1 to 20 carbon atoms or an arylsulfonamido group having from 6 to 20 carbon atoms), a sulfamoyl group (preferably an alkylsulfamoyl group having from 1 to 20 carbon atoms or an arylsulfamoyl group having from 6 to 20 carbon atoms), a carbamoyl group (preferably an alkylcarbamoyl group having from 1 to 20 carbon atoms or an arylcarbamoyl group having from 6 to 20 carbon atoms), an acyloxy group (preferably having from 1 to 20 carbon atoms), a substituted or unsubstituted amino group (preferably a secondary or tertiary amino group substituted with an alkyl group having from 1 to 20 carbon atoms or an aryl group having from 6 to 20 carbon atoms), a carbonic acid ester group (preferably an alkyl carbonate group having from 1 to 20 carbon atoms or an aryl carbonate group having from 6 to 20 carbon atoms), a sulfone group (preferably an alkylsulfone group having from 1 to 20 carbon atoms or an arylsulfone group having from 6 to 20 carbon atoms), a sulfinyl group (preferably an alkylsulfinyl group having from 1 to 20 carbon atoms or an arylsulfinyl group having from 6 to 20 carbon atoms), and the like.

In the above-described formula (V), $R_5$ represents a hydrogen atom, a substituted or unsubstituted alkyl group, a substituted or unsubstituted alkenyl group, a substituted or unsubstituted aryl group, etc.; X, $m_1$ and E are as defined above with repect to formula (III); and $Y_1$ and Z are as defined above with respect to formula (IV).

$R_5$ preferably represents a substituted or unsubstituted alkyl group having from 1 to 20 carbon atoms, a substituted or unsubstituted alkenyl group having from 2 to 20 carbon atoms or a substituted or unsubstituted aryl group having from 6 to 20 carbon atoms. Examples of the substituents for $R_5$ are the same as those enumerated for $R_4$ of the formula (IV).

Specific examples of the carbon ring or heterocyclic ring as represented by

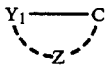

include cyclopentanone, cyclohaxanone, cycloheptanone, benzocycloheptanone, benzocyclopentanone, benzocyclohexanone, 4-tetrahydropyridone, 4-dihydroquinone, 4-tetrahydropyrrone, and the like. These carbon rings and heterocyclic rings may have one or more substituents which may be the same or different. Specific examples of the substituents are the same as those enumerated for the formula (IV).

In the above-described formula (VI), $Y_2$ represents

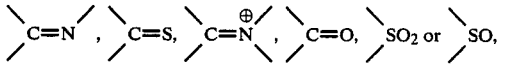

$R_6$ represents a hydrogen atom or a substituent bonded via a carbon atom thereof; $R_7$ and $R_8$, which may be the same or different, each represents a hydrogen atom or a substituent, or $R_7$ and $R_8$ may jointly form a double bond or a ring; $R_9$ represents a hydrogen atom or a substituent; $R_6$, $R_7$, $R_8$ and $R_9$ may be taken together to form a ring as long as the oxygen atom of the carbonyl group is capable of intramolecular nucleophilic attacking on $Y_2$; $m_2$ represents an integer of from 1 to 4; and $m_3$ represents 0 or 1. X, m and E are as defined above with respect to formula (III).

Specific examples of $R_6$ are a hydrogen atom, an alkyl group, an alkenyl group, an aryl group, a cycloalkyl group, and a heterocyclic group, etc. Of these, preferred are a hydrogen atom, an alkyl group having from 1 to 17 carbon atoms, an alkenyl group having from 3 to 17 carbon atoms, a phenyl group having from 6to 21 carbon atoms and a heterocyclic group containing from 4 to 21 carbon atoms.

Examples of the heterocyclic group represented by $R_6$ includes a pyrimidine ring, a triazine ring, a pyridine ring, a quinoline ring, a benzimidazole ring, a benzothiazole ring, a benzoxazole ring, an imidazoline ring, etc.

$R_7$ and $R_8$, which may be the same or different, each preferably represents a hydrogen atom, a halogen atom, a substituted or unsubstituted alkyl group, a substituted or unsubstituted alkenyl group, a substituted or unsubstituted phenyl group, a hydroxyl group, a substituted or unsubstituted alkoxy group or a substituted or unsubstituted acyl group. $R_7$ and $R_8$ may be bonded via a double bond or may form a ring. When $m_2$ is from 2 to 4, the carbon atoms to which $R_7$ and $R_8$ are bonded may jointly form a cycloalkyl aromatic ring or a hetero ring (e.g., a pyrimidine ring, a triazine ring, a pyridine ring, a quinoline ring, a benzimidazole ring, a benzothiazole ring, a benzoxazole ring, an imidazoline ring, etc.).

More preferably, $R_7$ and $R_8$ each represents a hydrogen atom, a halogen atom or an alkyl group. The particularly preferred ring formed by the carbon atoms to which $R_7$ and $R_8$ are bonded is a phenyl group.

$R_9$ preferably represents an alkyl group, an alkenyl group or a phenyl group. More preferably, $R_9$ represents an alkyl group having from 1 to 18 carbon atoms or a phenyl group having from 6 to 21 carbon atoms.

$Y_2$ preferably represents a carbonyl group or a sulfonyl group.

$m_2$ is an integer of from 1 to 4. $m_3$ is 0 or 1.

$m_2$ preferably represents an integer of from 1 to 3. It is particularly preferable that when $m_2$ it 1, $m_3$ represents 1; when $m_2$ is 2, $m_3$ represents 0 or 1; and when $m_2$ is 3, $m_3$ represents 0. When $m_2$ is 2 or 3, each unit

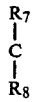

may be the same or different.

Specific but non-limiting examples of the blocked development restrainers represented by the formula (II) according to the present invention are shown below:

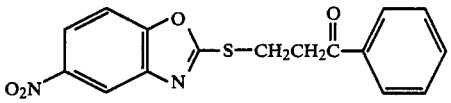

II-1

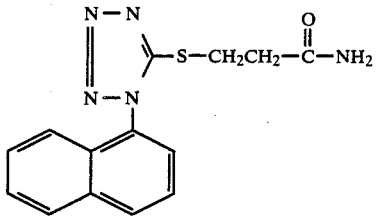

II-2

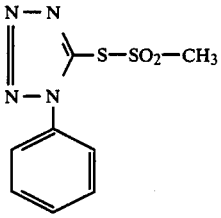

II-3

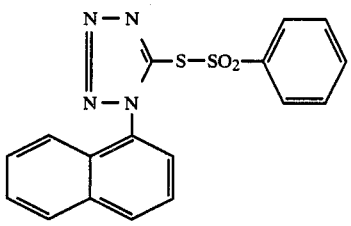

II-4

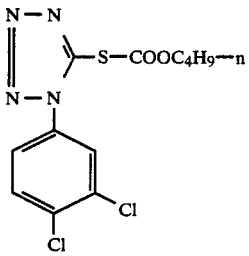

II-5

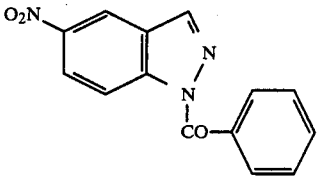

II-6

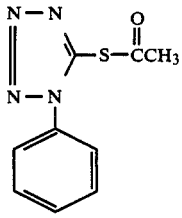

II-7

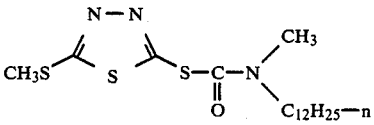

II-8

-continued
II-9
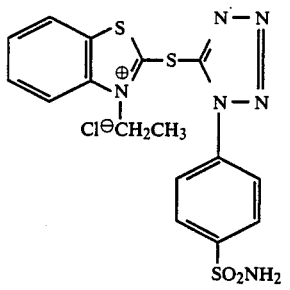
II-10
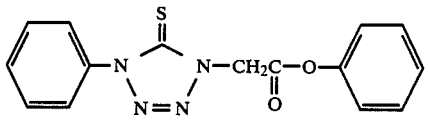
II-11
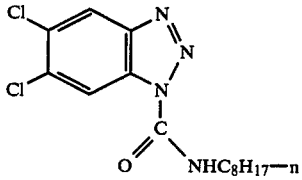
II-12
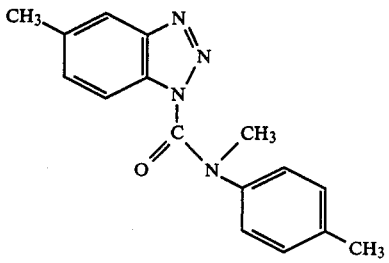
II-13
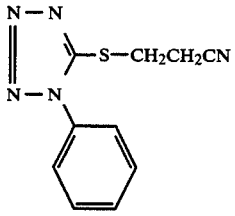
II-14
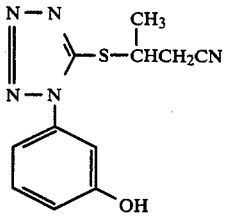
II-15
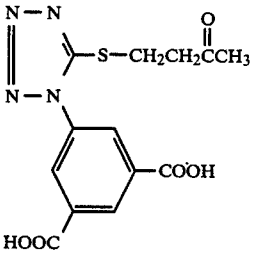
II-16
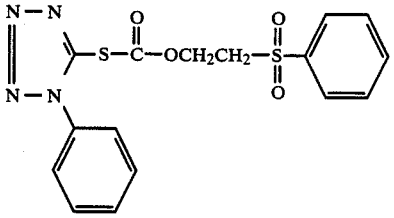
II-17
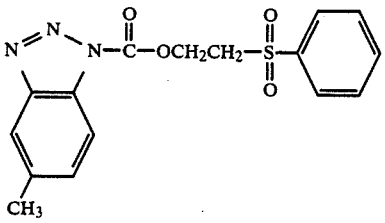
II-18
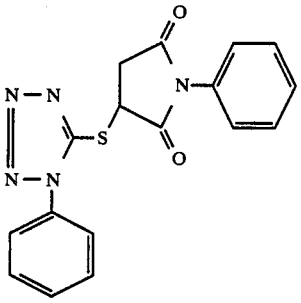
II-19
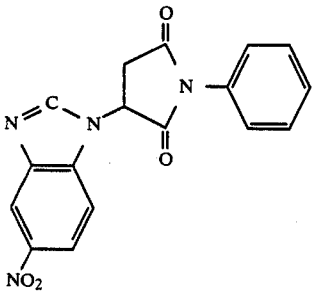
II-20
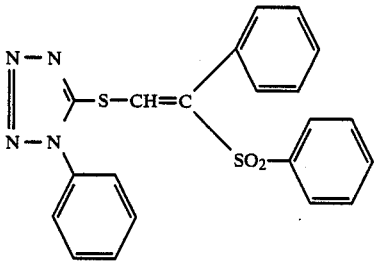

-continued
II-21
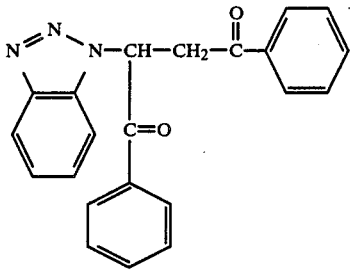
II-22
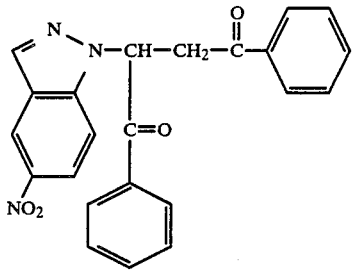
II-23
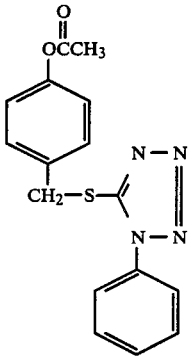
II-24
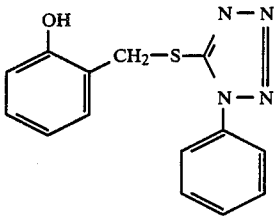
II-25
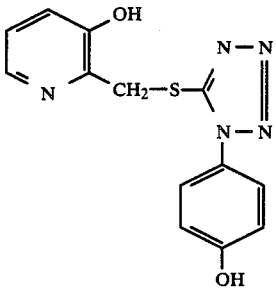
II-26
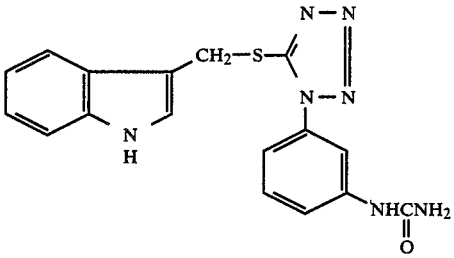
II-27
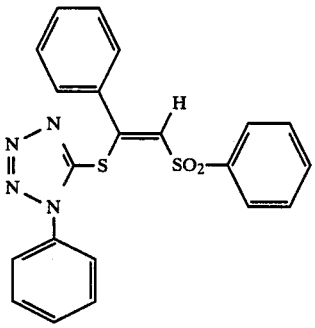
II-28
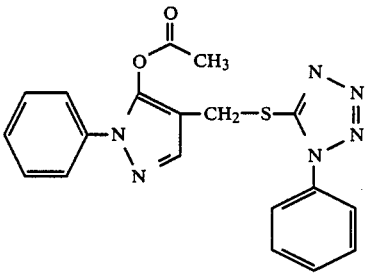
II-29
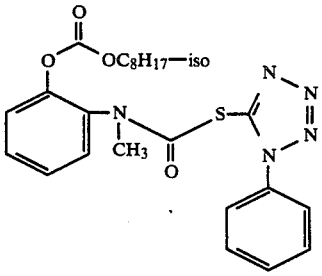
II-30
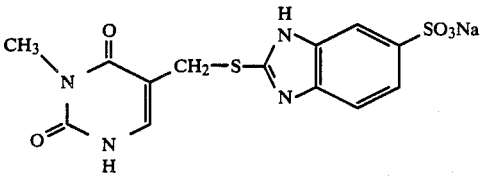

-continued
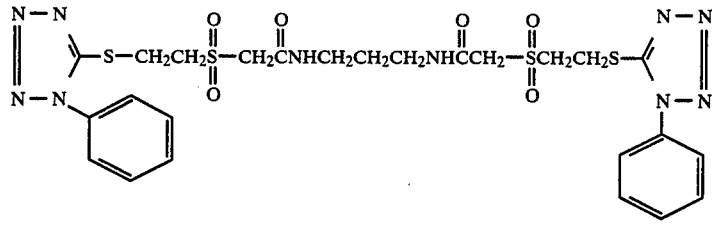
II-31
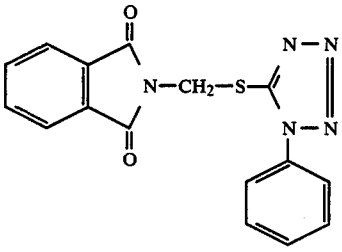
II-32
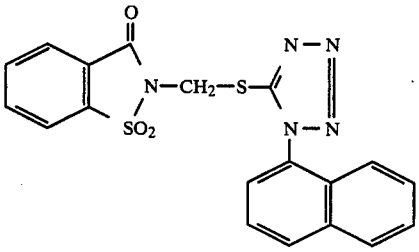
II-33
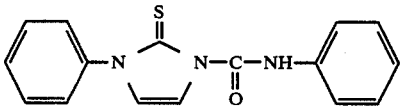
II-34
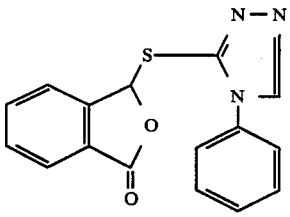
II-35
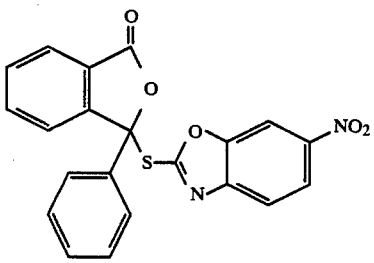
II-36
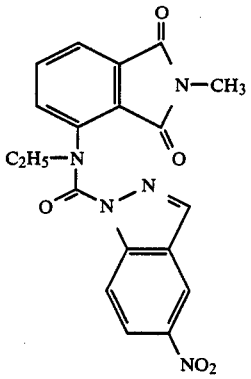
II-37
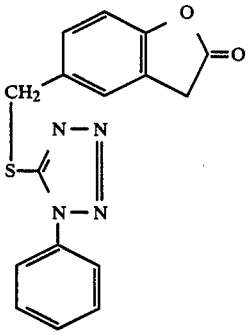
II-38
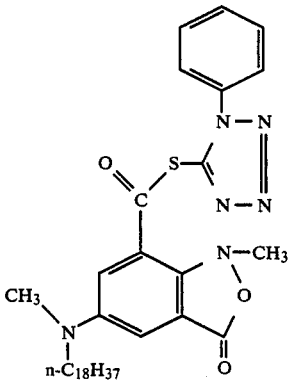
II-39

-continued
II-40
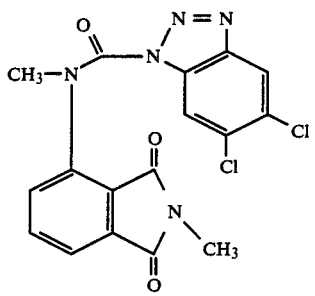
II-41
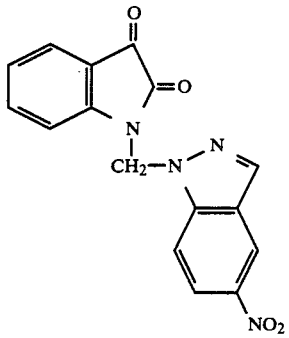
II-42
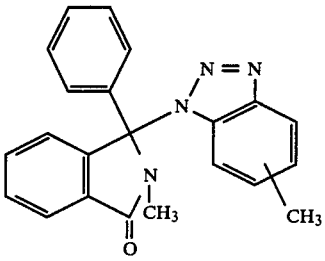
II-43
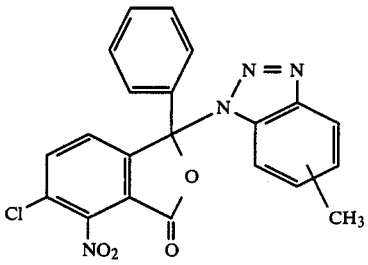
II-44
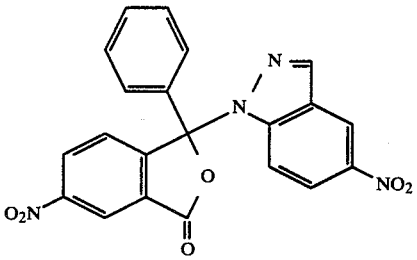
II-45
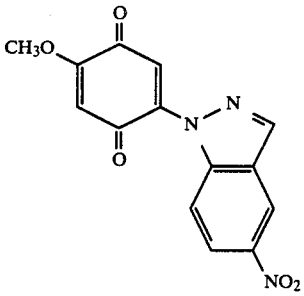
II-46
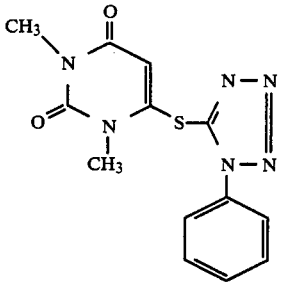
II-47
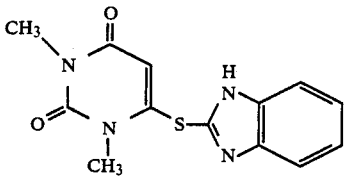
II-48
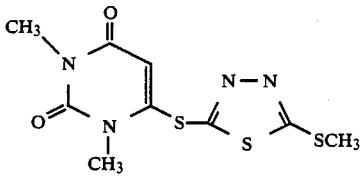
II-49
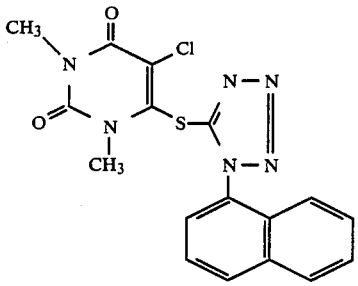
II-50
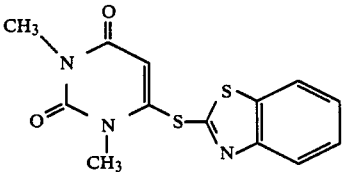
II-51
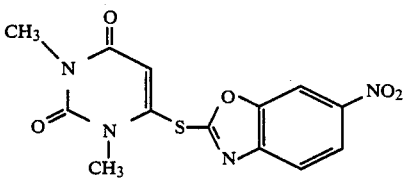

-continued
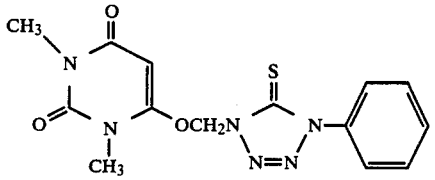
II-52
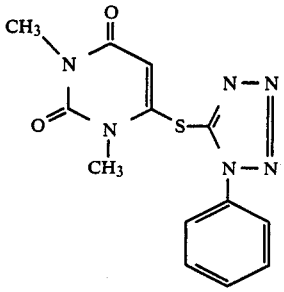
II-53
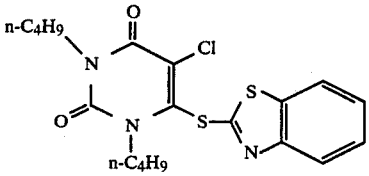
II-54
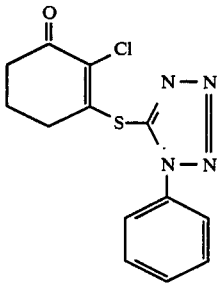
II-55
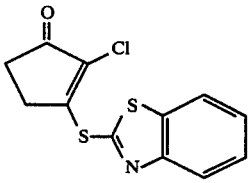
II-56
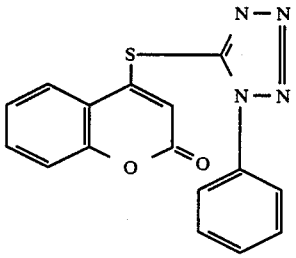
II-57
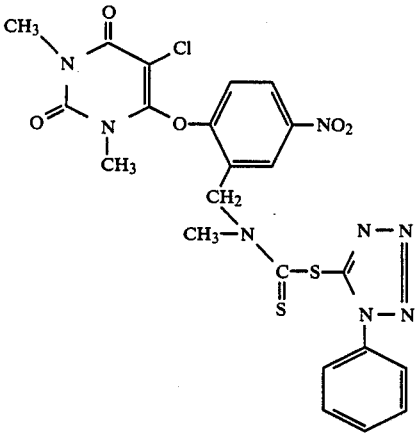
II-58
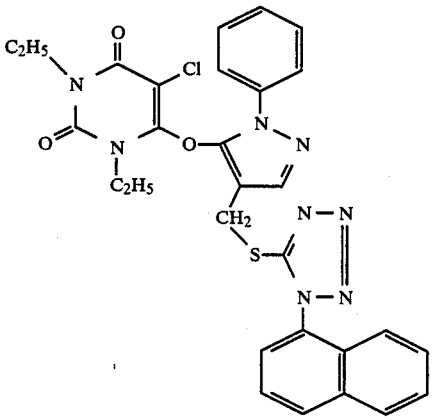
II-59
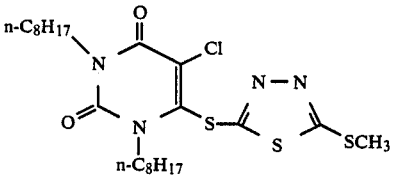
II-60
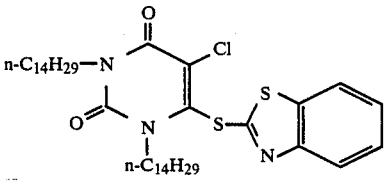
II-61

-continued
II-62
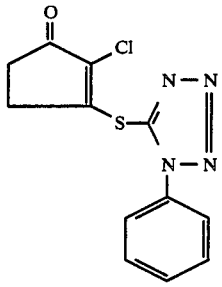
II-63
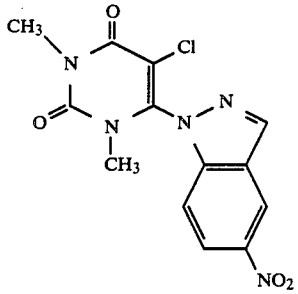
II-64
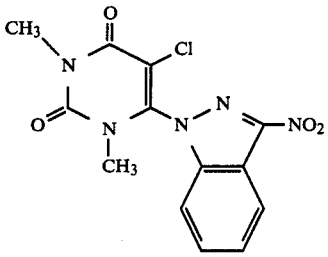
II-65
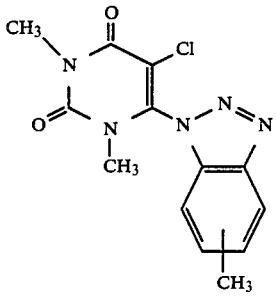
II-66
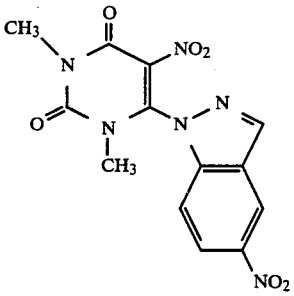
II-67
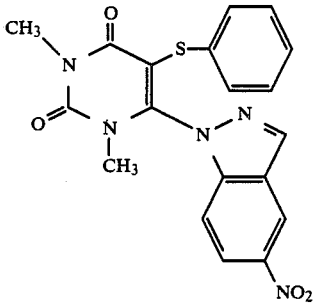
II-68
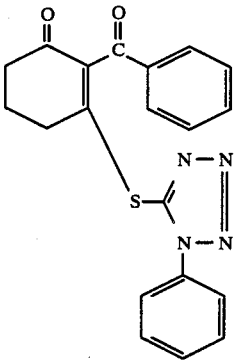
II-69
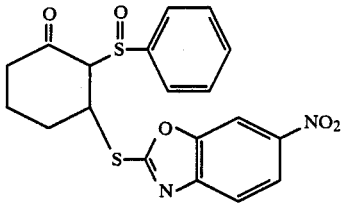
II-70
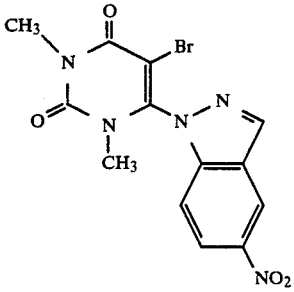
II-71
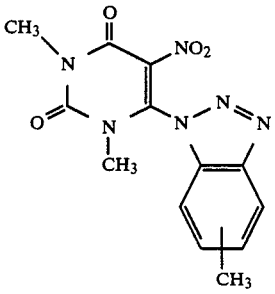

-continued
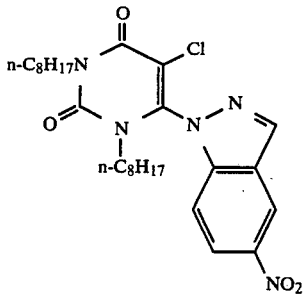
II-72
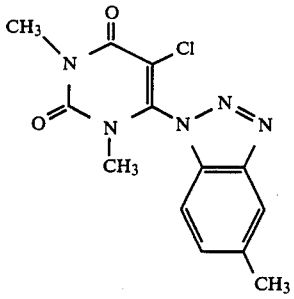
II-73
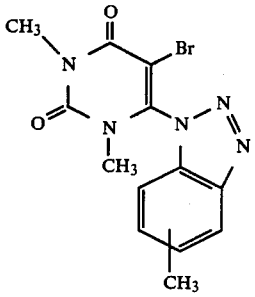
II-74
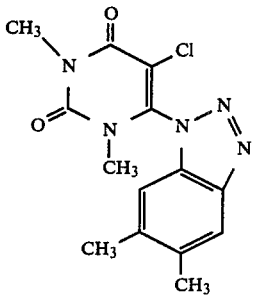
II-75
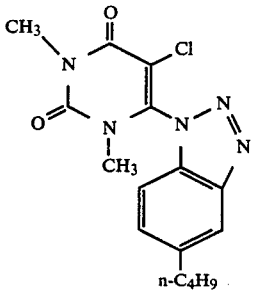
II-76
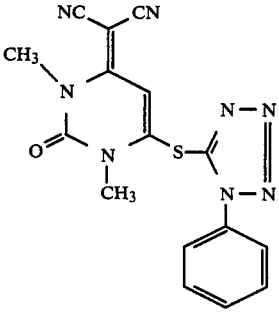
II-77
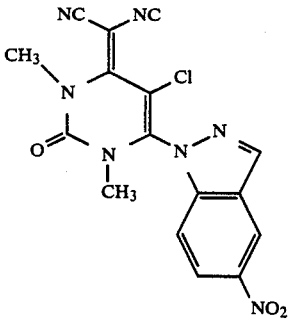
II-78
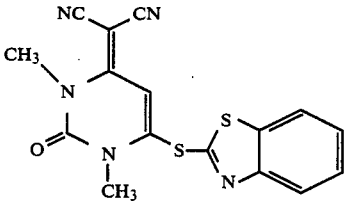
II-79
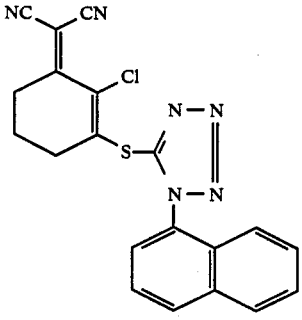
II-80
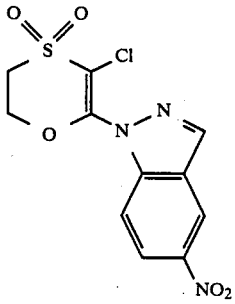
II-81

-continued
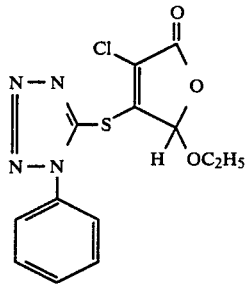
II-82
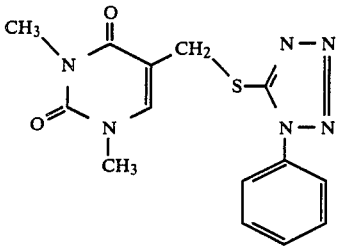
II-83
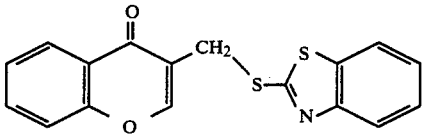
II-84
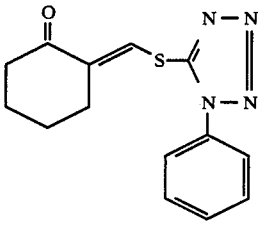
II-85
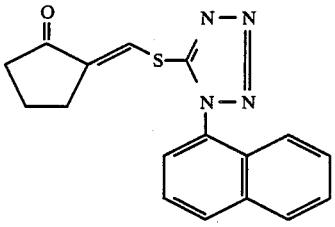
II-86
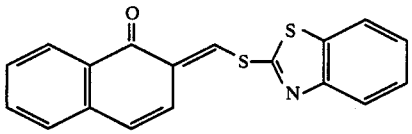
II-87
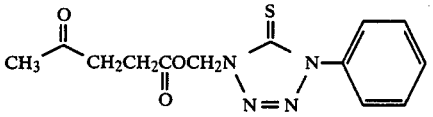
II-88
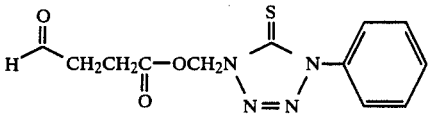
II-89
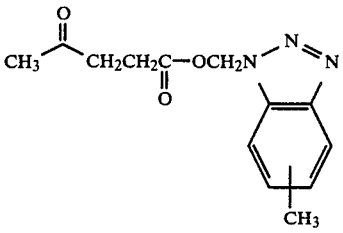
II-90
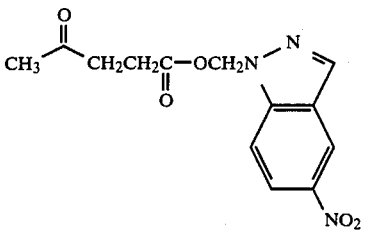
II-91
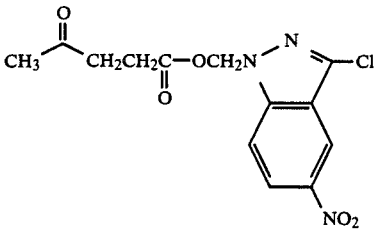
II-92
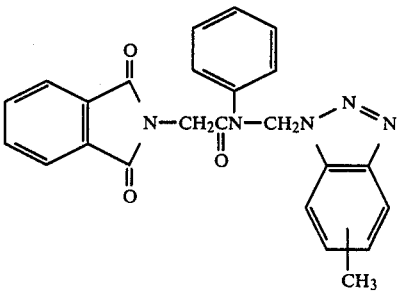
II-93

-continued

II-94

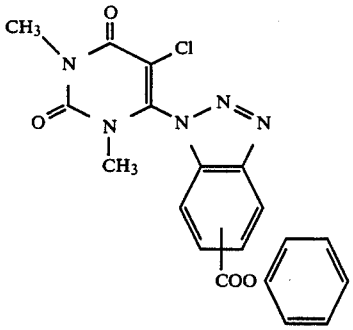

II-95

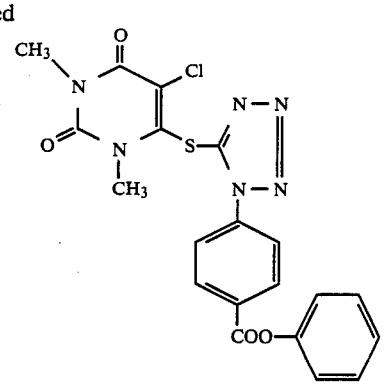

II-96

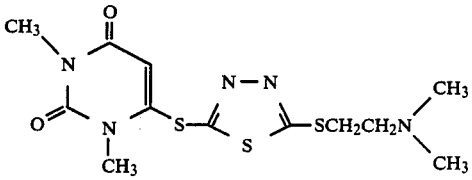

Processes for synthesizing the compounds of the formula (I) which can be used in the present invention are described, e.g., in Japanese Patent Application (OPI) Nos. 20921/78, 20922/78, 66732/78 and 20318/78, U.S. Pat. Nos. 4,459,347 and 4,478,928, etc.

Processes for synthesizing the blocked development restrainers of the formula (II) which can be used in the present invention are described in, e.g., Japanese Patent Publication No. 44805/72 (corresponding to U.S. Pat. No. 3,615,617), Japanese Patent Publication No. 9968/73, Japanese Patent Application (OPI) Nos. 8828/77 and 82834/82, Japanese Patent Publication Nos. 17369/80, 9696/80, 34927/80 and 77842/81 (corresponding to U.S. Pat. Nos. 3,888,677, 3,791,830, 4,009,029 and 4,307,175, respectively), Japanese Patent Publication No. 39727/79, Japanese Patent Application (OPI) Nos. 135944/82, 135945/82, 136640/82 and 53330/80, Japanese Patent Application (OPI) No. 76541/82 (corresponding to U.S. Pat. No. 4,335,200), Japanese Patent Application (OPI) Nos. 135949/82, 179842/82, 201057/84, 218439/84, 131945/84, 140445/84, 219741/84, 41034/85, 105642/84 and 105640/84, Japanese Patent Application No. 145593/84 (corresponding to Japanese Patent Application (OPI) No. 43739/86, Japanese Patent Application Nos. 216926/84 and 216928/84, etc.

Synthesis examples of the blocked development restrainers represented by the formula (II) are shown below. In the following Examples all amounts, ratios, etc., are by weight unless otherwise noted.

SYNTHESIS EXAMPLE 1

Synthesis of Compound II-46

6-Chloro-1,3-dimethyluracil was synthesized according to the process described in *Liebigs Ann. Chem.*, 612, 161 (1958) as follows.

In 600 ml of glacial acetic acid were dissolved 276 g (3.14 mol) of 1,3-dimethylurea and 376 g (3.62 mol) of malonic acid at 60° to 70° C. To the solution was added 1,250 ml of acetic anhydride, followed by elevating the temperature gradually up to 90° C. After stirring for 6 hours, the mixture was allowed to stand at room temperature overnight, and then the glacial acetic acid and acetic anhydride were removed by distillation under reduced pressure. The residue, while hot, was poured into 500 ml of ethanol, and the precipitated crystals were collected by filtration. The crystals were heat-refluxed in 380 ml of concentrated hydrochloric acid and 400 ml of water for 2 hours and then allowed to stand for 6 hours under ice-cooling. The precipitated crystals were collected by filtration and washed with a small amount of ethanol to obtain 360 g (73%) of 1,3-dimethylbarbituric acid having a melting point of 124° to 125° C.

To 110 g of the resulting 1,3-dimethylbarbituric acid was added 32 ml of water, and 800 ml of phosphorus oxychloride was slowly added dropwise thereto. After heating at reflux for 1.5 hours, the phosphorus oxychloride was removed by distillation at normal pressure. The residue, while hot, was poured onto ice, and the thus formed crystals were collected by filtration. The filtrate was extracted three times with chloroform and dried over anhydrous sodium sulfate, followed by distillation to remove chloroform. The residue was combined with the above obtained crystals. Recrystallization from water gave 80 g (64%) of 6-chloro-1,3-dimethyluracil having a melting point of 113° to 115° C.

Separately, 1.93 g (0.01 mol) of a 28% methanolic solution of sodium methylate was added to a solution of 1.78 g (0.01 mol) of 5-mercapto-1-phenyltetrazole in 20 ml of methanol. After stirring the mixture at room temperature for 5 minutes, the methanol was removed by distillation under reduced pressure. The residue was dissolved in 30 ml of tetrahydrofuran. To the resulting solution was added 1.75 g (0.01 mol) of the above prepared 6-chloro-1,3-dimethyluracil, and the mixture was heated with refluxing for 24 hours. The reaction mixture was poured into ice-water, and the precipitated crystals were collected by filtration and then recrystallized from methanol to obtain 1.60 g of Compound II-46 having a melting point of 170° C. (with decomposition) in a yield of 51%.

SYNTHESIS EXAMPLE 2

Synthesis of Compound II-47

A solution of 1.67 g (0.011 mol) of DBU (i.e., 1,5-diazabicyclo[5,4,0]undecene-5) in 10 ml of tetrahydrofuran was added to a solution of 1.50 g (0.01 mol) of 2-mercaptobenzimidazole in 40 ml of tetrahydrofuran at room temperature. To the mixture was then added a solution of 1.75 g (0.01 mol) of 6-chloro-1,3-dimethyluracil as prepared in Synthesis Example 1 in 10 ml of methanol, and the resulting mixture was heated at reflux for 11 hours. The reaction mixture was poured into ice-water, and the precipitated crystals were collected by filtration. Recrystallization from a mixed solvent of ethyl acetate and hexane gave 1.90 g of Compound II-47.

SYNTHESIS EXAMPLE 3

Synthesis of Compound II-55

To a suspension of 20.0 g (0.18 mol) of cyclohexane-1,3-dione in 100 ml of benzene was added 24.2 g (0.18 mol) of phosphorus trichloride. The mixture was heated at reflux for 1 hour. The solvent was removed by distillation under reduced pressure to obtain 19.2 g of 3-chloro-2-cyclohexen-1-one as a pale yellow oily substance in a yield of 81%.

Four grams (0.031 mol) of 3-chloro-2-cyclohexen-1-one was added to a solution of 5.47 g (0.031 mol) of 5-mercapto-1-phenyltetrazole, 10 ml of glacial acetic acid and 5.03 g (0.06 mol) of sodium acetate in 20 ml of tetrahydrofuran while stirring. The stirring was further continued at 60° to 70° C. for an additional 5 hours. The reaction mixture was poured into ice-water and extracted with ethyl acetate. The organic layer was dried over anhydrous sodium sulfate and concentrated. The resulting oily substance was purified by silica gel column chromatography using ethyl acetatehexane (1:4 by volume) as an eluent to obtain 6.3 g (75%) of Compound II-55 having a melting point of 69° to 71° C. as white crystals.

SYNTHESIS EXAMPLE 4

Synthesis of Compound II-62

Twenty milliliters of phosphorus trichloride were added to a solution of 16 g of cyclopentan-1,3-dione in 200 ml of chloroform, and the mixture was heat-refluxed for 5 hours. The reaction mixture was poured onto ice and extracted three times with ethyl acetate. The organic layer was dried over anhydrous sodium sulfate, followed by concentration. The resulting residue was distilled off under reduced pressure to yield 8 g (42%) of 3-chloro-2-cyclopenten-1-one having a boiling point of 77° to 78° C./25 mmHg as a colorless oily product.

To a solution of 1.29 g (0.011 mol) of the above-prepared 3-chloro-2-cyclopenten-1-one in 10 ml of tetrahydrofuran were added 1.78 g (0.01 mol) of 5-mercapto-1-phenyltetrazole, 1.64 g (0.02 mol) of sodium acetate and 40 ml of glacial acetic acid. The mixture was stirred at room temperature for 5 hours and then poured into ice-water. The precipitated crystals were collected by filtration and recrystallized from a mixed solvent of tetrahydrofuran and hexane to obtain 1.55 g (60%) of Compound II-62 having a melting point of 115° to 116° C.

SYNTHESIS EXAMPLE 5

Synthesis of Compound II-66

To 25 ml of sulfuric acid was slowly added 8.5 g (0.049 mol) of 6-chloro-1,3-dimethyluracil as prepared in Synthesis Example 1 at 10° to 15° C. To this solution was gradually added 8.5 ml of fuming nitric acid at 0° to 5° C. After stirring for 5 minutes, the reaction mixture was poured onto ice and extracted twice with chloroform. The organic layer was dried over anhydrous magnesium sulfate and concentrated. The resulting crystals were recrystallized from a mixed solvent of ethyl acetate and hexane to give 7.5 g (70%) of 6-chloro-1,3-dimethyl-5-nitrouracil having a melting point of 91° to 92° C.

Separately, a solution of 1.67 g (0.011 mol) of DBU in 10 ml of tetrahydrofuran was added to a solution of 1.79 g (0.011 mol) of 5-nitroindazole in 40 ml of tetrahydrofuran at room temperature, followed by stirring for 5 minutes. To the resulting mixture was then added 2.20 g (0.01 mol) of the above-prepared 6-chloro-1,3-dimethyl-5-nitrouracil, and the mixture was heated at reflux for 15 hours. The reaction mixture was poured into ice-water, and the precipitated crystals were filtered and recrystallized from ethanol to obtain 1.1 g (32%) of Compound II-66 having a melting point of 157° to 160° C.

SYNTHESIS EXAMPLE 6

Synthesis of Compound II-77

6-Chloro-1,3-dimethyluracil was synthesized in accordance with the process described in *Liebigs Ann. Chem. Bd.* 612, 161 (1958) as follows.

In 600 ml of glacial acetic acid were dissolved 276 g (3.14 mol) of 1,3-dimethylurea and 376 g (3.62 mol) of malonic acid at 60° to 70° C. Then, 1,250 ml of acetic anhydride was added thereto, and the temperature was gradually elevated up to 90° C. After stirring for 6 hours, the mixture was left to stand at room temperature overnight. The glacial acetic acid and acetic anhydride were removed by distillation under reduced pressure, and the residue, while hot, was poured into 500 ml of ethanol. The thus precipitated crystals were collected by filtration and heatrefluxed in 380 ml of concentrated hydrochloric acid and 400 ml of water for 2 hours, and then ice-cooled for 6 hours. The precipitated crystals were separated by filtration and washed with a small amount of ethanol to obtain 360 g of 1,3-dimethylbarbituric acid.

To 110 g of the 1,3-dimethylbarbituric acid was added 32 ml of water, and 800 ml of phosphorus oxychloride was added dropwise thereto. After heating at reflux for 1.5 hours, the phosphorus oxychloride was distilled away under normal pressure, and the residue, while hot, was poured onto ice. The precipitated crystals were collected by filtration. The filtrate was extracted three times with chloroform and dried over anhydrous sodium sulfate. The chloroform was then removed by distillation, and the resulting residue was combined with the aforesaid crystals. Recrystallization from water gave 80 g of 6-chloro-1,3-dimethyluracil.

To a solution of 6.6 g (0.1 mol) of malononitrile in 100 ml of tetrahydrofuran was added 4.0 g (0.1 mol) of 60 wt% sodium hydride under ice-cooling. Seventeen grams (0.1 mol) of 6-chloro-1,3-dimethyluracil were added thereto, followed by stirring at room temperature for 5 hours. A hundred milliliters of water were added to the mixture, and the mixture was neutralized with concentrated hydrochloric acid, followed by extraction with 200 ml of ethyl acetate. The extract was dried over anhydrous sodium sulfate, and the solvent was removed by distillation under reduced pressure, followed by filtration to obtain 12.9 g (63%) of 6-dicyanomethyl-1,3-dimethyluracil.

To 6.1 g (0.03 mol) of the resulting 6-dicyanomethyl-1,3-dimethyluracil was added 1.5 ml of water, and 40 ml of phosphorus oxychloride was added dropwise thereto. After heating the mixture at reflux for 1.5 hours, the phosphorus oxychloride was removed by distillation under normal pressure, and the residue was poured onto ice. The precipitated crystals were collected by filtration. The filtrate was extracted three times with chloroform and dried over anhydrous sodium sulfate. The chloroform was distilled away and the resulting residue was combined with the above obtained crystals. Recrystallization from water-methanol yielded 6.15 g of 6-chloro-1,3-dimethyl-2-oxo-4-dicyanomethylenepyrimidine.

Then, 1.93 g (0.01 mol) of a 28% methanolic solution of sodium methylate was added to a solution of 1.78 g (0.01 mol) of 5-mercapto-1-phenyltetrazole in 20 ml of methanol. After stirring at room temperature for 5 minutes, the methanol was removed by distillation under reduced pressure. The residue was dissolved in 30 ml of tetrahydrofuran, and 2.2 g (0.01 mol) of the above-obtained 6-chloro-1,3-dimethyl-2-oxo-4-dicyanomethylenepyrimidine was added to the resulting solution. The mixture was heated at reflux for 24 hours, and the reaction mixture was poured into ice-water. The precipitated crystals were collected by filtration and recrystallized from methanol to obtain 3.2 g (89%) of Compound II-77.

SYNTHESIS EXAMPLE 7

Synthesis of Compound II-83

Anhydrous potassium carbonate (48.3 g; 0.350 mol) and 49.8 g (0.350 mol) of methyl iodide were added to a suspension of 21.3 g (0.150 mol) of 5-hydroxymethyluracil (synthesized by the process described in *J. Heterocyclic Chem.*, 21, 9 (1984) in 100 ml acetonitrile, followed by heating at reflux for 30 hours while vigorously stirring. The reaction mixture was cooled and filtered by suction. The residue was washed with methanol. The filtrate and the washing were combined and concentrated under reduced pressure to obtain 16.1 g (63%) of 1,3-dimethyl-5-hydroxymethyluracil as a white crystal.

To a solution of 3.4 g (0.020 mol) of 1,3-dimethyl-5-hydroxymethyluracil in 30 ml of diglyme (i.e., diethylene glycol dimethyl ether), 7.5 ml (0.10 mol) of thionyl chloride was added dropwise while stirring under ice-cooling. The temperature was gradually elevated up to room temperature. Once at room temperature, the mixture was stirred for 6 hours. The reaction mixture was filtered by suction, and the filtrate was distilled under reduced pressure to remove the excess of thionyl chloride. To the residue was added 4.0 g (0.020 mol) of a sodium salt of 5-mercapto-1-phenyltetrazole (prepared from 5-mercapto-1-phenyltetrazole and an equimolar amount of sodium methylate) at room temperature, followed by stirring for 10 hours. The reaction mixture was poured into ice-water and extracted with chloroform. The organic layer was dried over anhydrous sodium sulfate and concentrated. The residue was purified by chromatography on an alumina column using chloroformethyl acetate as an eluent, followed by recrystallization from isopropanol to obtain 3.2 g of Compound II-83 as a white crystal having a melting point of 217° C. (with decomposition) in a yield of 49%.

SYNTHESIS EXAMPLE 8

Synthesis of Compound II-85

Twenty grams (0.2 mol) of cyclohexanone and 16 g (0.2 mol) of ethyl formate were dissolved in 400 ml of anhydrous diethyl ether, and 16 g (0.4 mol) of 60% sodium hydride was added thereto over a period of 1 hour while cooling in an ice bath. After completion of the addition, the mixture was stirred for 6 hours at room temperature. To the reaction mixture was added dropwise 150 ml of a diethyl ether solution of 27 g (0.2 mol) of phosphorus trichloride while cooling in an ice bath. After the addition, the reaction mixture was stirred at room temperature for 3 hours, and the thus formed precipitate was separated by filtration under reduced pressure. The mother liquor was concentrated to give 31 g of an oily product. The oily product, as such, was dissolved in 200 ml of anhydrous tetrahydrofuran, and the resulting solution was added dropwise into a solution of 36 g (0.2 mol) of 2-phenylmercaptotetrazole and 40 g (0.4 mol) of triethylamine in 500 ml of anhydrous tetrahydrofuran through a dropping funnel at room temperature. The reaction mixture was stirred at room temperature for 4 hours. After the tetrahydrofuran was removed by distillation under reduced pressure, water was added to the residue. The mixture was repeatedly extracted with ethyl acetate, and the organic layer was washed with water, dried and distilled under reduced pressure to remove the organic solvent to obtain 61 g of crude crystals, which were then recrystallized twice with ethyl acetate-hexane to obtain 48 g of Compound II-85 as a white crystal having a melting point of 152° to 155° C.

In the present invention, the above-described compounds represented by the formulae (I) and (II) are preferably incorporated in a silver halide emulsion layer of the photographic light-sensitive material, but may also be incorporated in other light-insensitive hydrophilic colloidal layers, such as a protective layer, an intermediate layer, a filter layer, an antihalation layer, and the like. More specifically, they are added to a hydrophilic colloid solution in the form of an aqueous solution thereof when being water-soluble or in the form of a solution in a water-miscible organic solvents, such as alcohols, esters, ketones, and the like, when being sparingly water-soluble. Addition to the silver halide emulsion layer may be effected at any stage from the start of chemical ripening through the stage before coating, preferably from the end of chemical ripening through the stage before coating, and more preferably immediately before coating.

The amount of the compound (I) or (II) to be added is appropriately selected depending upon the grain size and halogen composition of the silver halide emulsion, the method and degree of chemical ripening, the relationship between the layer to which the compound is added and the silver halide emulsion layer, the type of antifoggant used, and the like. The testing method for such selection is well known in the art. Usually, the compound (I) is used in an amount ranging from $1\times10^{-6}$ to $1\times10^{-1}$ mol, and preferably from $1\times10^{-5}$ to $4\times10^{-1}$ mol, per mol of silver halide, and the compound (II) is used in an amount of from $5\times10^{-6}$ to 1.0 mol, and preferably from $1\times10^{-5}$ to $1\times10^{-1}$ mol, per mol of silver halide.

$R_4$, $R_5$ and $R_6$ in the above-described formulae (IV), (V) and (VI), respectively, can be selected based on the pH and the composition of the processing solution with which the photographic element containing the blocked development restrainer is processed and the timing required.

Further, the rate of release of the development restrainer from the blocked development restrainer can be widely varied, not only by controlling the pH of the processing solution, but also by using a nucleophilic substance, such as a sulfite ion, a hydroxylamine, a thiosulfate ion, a metabisulfite ion, a hydroxamic acid and its analogues as described in Japanese Patent Application (OPI) No. 198453/84, an oxime compounds as described in Japanese Patent Application (OPI) No. 35729/85, dihydroxybenzene developing agent, 1-phenyl-3-pyrazolidone developing agent and p-aminophenol developing agent as described below, and so on.

Use of such a nucleophilic substance makes it possible to accelerate release of a development restrainer. To this effect, the nucleophilic substance is preferably used in an amount of $10^2$ to $10^6$ times the molar amount of the blocked development restrainer.

Silver halide grains which can be used in the present invention may have any halogen composition, e.g., silver chloride, silver chlorobromide, silver iodobromide, silver iodochlorobromide, etc. In particular, silver halides having a silver bromide content of 70 mol% or more, more preferably 90 mol% or more, and a silver iodide content of 10 mol% or less, more preferably from 0.1 to 5 mol%, are preferred.

The silver halide grains to be used in the present invention are preferably fine grains, e.g., having a mean grain size of not more than 0.7 μm and, more preferably, not more than 0.5 μm. Grain size distribution is not essentially restricted, but a mono-dispersed silver halide emulsion having narrow grain size distribution is preferred. Herein the term "mono-dispersed emulsion" means an emulsion wherein at least 95% of the weight or number of total silver halide grains is included in a size range within ±40% of the mean grain size.

Silver halide grains in the photographic emulsion may have a regular crystal form, such as a cube, an octahedron, etc., or an irregular crystal form, e.g., a sphere, a plate, etc., or a composite form thereof.

The silver halide grains may have a homogeneous phase or a heterogeneous phase through the surface layer to the interior thereof. Two or more different silver halide emulsions separately prepared may be used as a mixture.

In the formation of silver halide grains or the physical ripening thereof, a cadmium salt, a sulfurous acid salt, a lead salt, a thallium salt, a rhodium salt or a complex salt thereof, an iridium salt or a complex salt thereof, etc. may be present in the silver halide emulsion.

A silver halide that is particularly suitable for the present invention is prepared in the presence of an iridium salt or a complex salt thereof in an amount of from $10^{-8}$ to $10^{-5}$ mol per mol of silver and has a larger silver iodide content in the surfaces of each grain than the average throughout the whole of each individual grain. Use of an emulsion containing such a silver haloiodide results in higher sensitivity and increased gamma.

The iridium salt of the above-specified amount is desirably added to the silver halide emulsion by the end of physical ripening, particularly during the grain formation.

Iridium salts which can be used include water-soluble iridium salts or iridium complex salts, such as iridium trichloride, iridium tetrachloride, potassium hexachloroiridate (III), potassium hexachloroiridate (IV), ammonium hexachloroiridate (III), etc.

The term "surface of grains", as set forth above, means the surface layer from the outer surface to a depth of from 100 Å to 200 Å. In the present invention, it is particularly preferable that the silver iodide content in the surfaces of each silver haloiodide grain be 50% or more greater than the average throughout the whole of each individual grain. The silver iodide content in the surfaces of silver haloiodide grains can be determined by the use of an X-ray photoelectric spectrophotometer (XPS). The average silver iodide content throughout the whole of each individual grain can also be determined by XPS after annealing a sample at 300° C. for 3 hours to make the silver iodide distribution uniform.

The silver haloiodide emulsion having the abovedescribed silver iodide distribution can be prepared by commonly employed techniques, such as the conversion process described in U.S. Pat. Nos. 2,592,250 and 4,075,020 and Japanese Patent Application (OPI) No. 127549/80, etc., and the process for preparing core/-shell emulsions described in British Patent No. 1,027,146, etc. In some detail, employable processes include, for example, a process which comprises simultaneously adding a silver nitrate aqueous solution and a potassium bromide aqueous solution to a gelatin solution kept at a given temperature so as to maintain the pAg constant to thereby prepare silver bromide and then adding a potassium iodide aqueous solution thereto to convert the surfaces of the grains; the same process as described above, but wherein a potassium iodide aqueous solution is simultaneously added with the potassium bromide aqueous solution immediately before the completion of the addition of the silver nitrate aqueous solution (in place of adding the potassium iodide after the silver bromide is prepared); a similar process to that described above, but wherein silver iodide fine grains are added into a reaction vessel at any stage immediately before the completion of the addition of the silver nitrate aqueous solution through after completion of the addition of the silver nitrate aqueous solution, thereby forming a silver iodide (shell) on the surfaces of silver bromide grains (core) by Ostwald ripening; and the like. In these processes, the grain size can be varied by changing the time of addition of the silver nitrate aqueous solution and potassium bromide aqueous solution and the temperature of the reaction vessel.

Binders or protective colloids for photographic emulsions include gelatin to advantage, but other hydrophilic colloids may also be employed. Examples of usable hydrophilic colloids include proteins, such as gelatin derivatives, graft polymers of gelatin with other high polymers, albumin, casein, etc.; cellulose derivatives, such as hydroxyethyl cellulose, carboxymethyl cellulose, cellulose sulfate, etc.; sugar derivatives, such as sodium alginate, starch derivatives, etc.; and a wide variety of synthetic hydrophilic high polymers, such as homopolymers, e.g., polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., and copolymers comprising monomers constituting these homopolymers.

Gelatin to be used includes lime-processed gelatin, acid-processed gelatin and, in addition, hydrolysis products or enzymatic decomposition products of gelatin.

After grain formation or physical ripening, soluble salts are usually removed from the emulsion. Removal of soluble salts can be carried out by a conventionally known noodle washing method comprising gelling the gelatin or by a flocculation method using an inorganic salt composed of a polyvalent anion, e.g., sodium sulfate, an anionic surface active agent, an anionic polymer, e.g., polystyrenesulfonic acid, or a gelatin derivative, e.g., aliphatic acylated gelatin, aromatic acrylated gelatin, aromatic carbamoylated gelatin, etc. The removal of soluble salts may be omitted.

The silver halide emulsion which can be used in the present invention may or may not be subjected to chemical sensitization. Chemical sensitization can be carried out by sulfur sensitization, reduction sensitization, noble metal sensitization or a combination thereof.

Gold sensitization, which is a typical example of noble metal sensitization, employs a gold compound, mainly a complex salt thereof. Complex salts of noble metals other than gold, such as platinum, palladium, iridium, etc., can be incorporated. Specific examples thereof are described in U.S. Pat. No. 2,448,060, British Patent No. 618,061 and so on.

Sulfur sensitization can be conducted with sulfur compounds contained in gelatin or various sulfur compounds, such as thiosulfates, thioureas, thiazoles, rhodanines, etc. Specific examples of these sulfur sensitizers are described in U.S. Pat. Nos. 1,574,944, 2,278,947, 2,410,689, 2,728,668, 3,501,313 and 3,656,952.

Reduction sensitization can be achieved with stannous salts, amines, formamidinesulfinic acid, silane compounds, etc. Specific examples of these reducing materials are described in U.S. Pat. Nos. 2,487,850, 2,518,698, 2,983,609, 2,983,610 and 2,694,637.

For the purpose of increasing sensitivity, the light-sensitive materials of the present invention can contain sensitizing dyes, such as cyanine dyes, merocyanine dyes, etc., as described in Japanese Patent Application (OPI) No. 52050/80, pp. 45–53. These sensitizing dyes may be used either alone or in combination thereof. Combinations of sensitizing dyes are frequently used particularly for the purpose of supersensitization. The photographic emulsions may contain, in addition to the sensitizing dyes, a dye which has per se no spectrally sensitizing effect or a substance which does not substantially absorb visible light, but said dye or substance exhibiting supersensitizing effect. Specific examples of useful sensitizing dyes, combinations of dyes for supersensitization and substances exhibiting supersensitizing effect are given in *Research Disclosure,* Vol. 176, 17643, page 23, IV-J (Dec. 1978).

The photographic materials according to the present invention can contain, in addition to the compounds represented by the formula (II), various compounds known as antifoggants or stabilizers for the purpose of preventing fog during preparation, preservation or photographic processing of the materials or for stabilizing photographic performances. Examples of such compounds are azoles, e.g., benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyrimidines; mercaptotriazines; thioketo compounds, e.g., oxazolinethione, etc.; azaindenes, e.g., triazaindenes, tetraazaindenes (especially 4-hydroxy-substituted(1,3,3a,7)tetraazaindenes), pentaazaindenes, etc.; benzenethiosulfonic acid; benzenesulfinic acid; benzenesulfonic acid amide; and the like. Preferred among them are benzotriazoles, e.g., 5-methylbenzotriazole, and nitroindazoles, e.g., 5-nitroindazole. These compounds may also be incorporated in a processing solution.

The photographic emulsion layers or other hydrophilic colloidal layers of the photographic materials of the present invention may contain an organic or inorganic hardener, such as a chromium salt, e.g., chromium alum, chromium acetate, etc.; aldehyde, e.g., formaldehyde, glyoxal, glutaraldehyde, etc.; an N-methylol compound, e.g., dimethylolurea, methyloldimethylhydantoin, etc.; dioxane derivative, e.g., 2,3-dihydroxydioxane, etc.; an active vinyl compound, e.g., 1,3,5-triacryloyl-hexahydro-s-triazine, 1,3-vinylsulfonyl-2-propanol, etc.; an active halogen compound, e.g., 2,4-dichloro-6-hydroxy-s-triazine, etc.; a mucohalogenic acid, e.g., mucochloric acid, mucophenoxychloric acid, etc.; and the like, either alone or in combinations thereof.

The photographic emulsion layers or other hydrophilic colloidal layers of the photographic materials of this invention may further contain a wide variety of surface active agents for various purposes, for example, for coating aid, prevention of static charge, improvement of slipperiness, emulsification aid, prevention of adhesion, improvement of photographic characteristics (e.g., development acceleration, increase in contrast, increase in sensitivity, etc.), and the like.

Examples of the surface active agents to be used include nonionic surface active agents, such as saponin (steroid type), alkylene oxide derivatives, e.g., polyethylene glycol, polyethylene glycol/polypropylene glycol condensates, polyethylene glycol alkyl ethers or polyethylene glycol alkyl aryl ethers, polyethylene glycol esters, polyethylene glycol sorbitan esters, polyalkylene glycol alkylamines or amides, polyethylene oxide adducts of silicone, etc., glycidol derivatives, e.g., alkenylsuccinic polyglycerides, alkylphenyl polyglycerides, etc., fatty acid esters of polyhydric alcohols, alkyl esters of sugars, and the like; anionic surface active agents containing acidic groups, e.g., a carboxyl group, a sulfo group, a phospho group, a sulfuric ester group, a phosphoric ester group, etc., such as alkylcarboxylates, alkylsulfonates, alkylbenzenesulfates, alkylnaphthalenesulfates, alkylsulfates, alkylphosphates, N-acyl-N-alkyltaurins, sulfosuccinates, sulfoalkylpolyoxyethylene alkyl phenyl ethers, polyoxyethylene alkylphosphates, and the like; amphoteric surface active agents, such as amino acids, aminoalkylsulfonic acids, aminoalkyl sulfates or phosphates, alkylbetaines, amine oxides, and the like; and cationic surface active agents, such as alkylamine salts, aliphatic or aromatic quaternary ammonium salts, heterocyclic quaternary ammonium salts, e.g., pyridinium, imidazolium, etc., aliphatic or heterocyclic phosphonium or sulfonium salts, and the like.

Of these, polyalkylene oxides having a molecular weight of 600 or more, as described in Japanese Patent Publication No. 9412/83, are preferably used in the present invention.

The photographic emulsion layers or other hydrophilic colloidal layers of the photographic materials according to the present invention may contain a hydroquinone derivative capable of releasing a development restrainer (development inhibitor) according to a density of an image upon processing (the so-called DIR-hydroquinone). Specific examples of such a hydroquinone derivative are described in U.S. Pat. Nos. 3,379,529, 3,620,746, 4,377,634 and 4,332,878, Japanese Patent Application (OPI) Nos. 129536/74, 67419/79, 153336/81 and 153342/81, Japanese Patent Application No. 278853/84, Japanese Patent Application Nos.

90435/84, 90436/84 and 138808/84 (corresponding to Japanese Patent Application (OPI) Nos. 233642/85, 233648/85 and 18946/86, respectively), etc.

The photographic emulsion layers or other hydrophilic colloidal layers of the photographic materials of the present invention may contain a matting agent, such as silica, magnesium oxide, polymethyl methacrylate, etc., for the purpose of preventing adhesion.

The photographic materials which can be used in the present invention can contain a dispersion of a water-insoluble or slightly water-soluble synthetic polymer for improving dimensional stability or a like purpose. Examples of such a polymer are polymers comprising a monomer or monomers selected from alkyl (meth)acrylates, alkoxyalkyl (meth)acrylates, glycidyl (meth)acrylates, (meth)acrylamides, vinyl esters (e.g., vinyl acetate), acrylonitrile, olefins, styrene, and so on; and polymers comprising a monomer or monomers selected from the above-described compounds and a monomer or monomers selected from acrylic acid, methacrylic acid, $\alpha,\beta$-unsaturated dicarboxylic acids, hydroxyalkyl(meth)acrylates, sulfoalkyl(meth)acrylate, styrenesulfonic acid, and so on. Specific examples of these polymers are described, e.g., in U.S. Pat. Nos. 2,376,005, 2,739,137, 2,853,457, 3,062,674, 3,411,911, 3,525,620, 3,607,290, and 3,645,740.

Developing agents which can be used in a developer which can be used in the present invention are not particularly limited. However, the one containing dihydroxybenzenes are preferred in view of ease in obtaining satisfactory dot quality. Combinations of dihydroxybenzenes and 1-phenyl-3-pyrazolidones or combinations of dihydroxybenzenes and p-aminophenols are sometimes used.

The dihydroxybenzene developing agents to be used in the present invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone, etc., with hydroquinone being particularly preferred.

The 1-phenyl-3-pyrazolidone developing agents or derivatives thereof which can be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, etc.

The p-aminophenol type developing agents which can be used in the present invention include N-methyl-p-aminophenol, p-aminophenol, N-($\beta$-hydroxyethyl)-p-aminophenol, N-(4-hydroxyphenyl)glycine, 2-methyl-p-aminophenol, p-benzylaminophenol, etc., with N-methyl-p-aminophenol being particularly preferred.

The developing agent is preferably used in an amount of from 0.05 mol/l to 0.8 mol/l. In case of using combinations of dihydroxybenzenes and 1-phenyl-3-pyrazolidones or p-aminophenols, it is preferable to use the former in an amount of from 0.05 mol/l to 0.5 mol/l, and the latter in an amount of not more than 0.06 mol/l.

Sulfites which can be used as preservatives in the present invention include sodium sulfite, potassium sulfite, lithium sulfite, ammonium sulfite, sodium bisulfite, potassium metabisulfite, formaldehydesodium bisulfite, and the like. The sulfite is preferably used in an amount of from 0.4 mol/l, and particularly from 0.5 mol/l to 2.5 mol/l.

Alkalis which can be used for pH adjustment in the present invention include pH adjusters or buffers, such as sodium hydroxide, potassium hydroxide, sodium carbonate, potassium carbonate, sodium tertiary phosphate, potassium tertiary phosphate, etc. A developer used in the present invention is adjusted to a pH between 10.5 and 12.3.

Other additives which can be contained in the photographic materials of this invention include boron compounds, e.g., boric acid, borax, etc.; development restrainers, e.g., sodium bromide, potassium bromide, potassium iodide, etc.; organic solvents, e.g., ethylene glycol, diethylene glycol, triethylene glycol, dimethylformamide, methyl cellosolve, hexylene glycol, ethanol, methanol, etc.; antifoggants or black spot preventing agents, such as mercapto compounds, e.g., 1-phenyl-5-mercaptotetrazole, sodium 2-mercaptobenzimidazole-5-sulfonate, etc., indazole compounds, e.g., 5-nitroindazole, etc., benzotriazole compounds, e.g., 5-methylbenzotriazole, etc., and the like. In addition, the light-sensitive materials of this invention may further contain, if desired, toning agents, surface active agents, defoaming agents, water softeners, hardeners, amino compounds described in Japanese Patent Application (OPI) No. 106244/81, and the like.

The present invention which is characterized by the use of at least one compound represented by the formula (I) in combination with at least one compound represented by the formula (II) makes it possible to obtain excellent photographic properties, i.e., markedly high sensitivity and high contrast that are effective for reproduction of dot images or line images and freedom from black spots on non-image areas.

The present invention will now be illustrated in greater detail with reference to the following examples, but it should be understood that these examples are not deemed to limit the present invention. In these examples, all amounts, ratios, etc., are by weight, unless otherwise noted. In these examples, a developer having the following formulation was used.

| Developer Formulation: | |
|---|---|
| Hydroquinone | 35.0 g |
| N—Methyl-p-aminophenol semisulfate | 0.8 g |
| Sodium hydroxide | 9.0 g |
| Potassium tertiary phosphate | 74.0 g |
| Potassium sulfite | 90.0 g |
| Disodium ethylenediaminetetraacetate | 1.0 g |
| Sodium bromide | 3.0 g |
| 5-Methylbenzotriazole | 0.5 g |
| 3-Diethylamino-1,2-propanediol | 15.0 g |
| Water to make | 1 liter |
| | (pH = 11.6) |

Emulsions I and II used in the examples were prepared as follows:

Emulsion I

A silver nitrate aqueous solution, a potassium iodide aqueous solution and a potassium bromide aqueous solution were simultaneously added to a gelatin aqueous solution kept at 50° C. over a period of 60 minutes in the presence of $4\times10^{-7}$ mol, per mol of silver, of potassium hexachloroiridate (III) and ammonia while maintaining the pAg of the system at 7.8 to thereby prepare a monodispersed emulsion of cubic silver halide grains having a mean grain size of 0.28 $\mu$m and an average silver ioide content of 1 mol%. After the emulsion was washed with water in a usual manner to remove soluble salts, gelatin was added thereto, and the emulsion was subjected to chemical sensitization using sodium thiosulfate. A potassium iodide aqueous solution was then added to the emulsion in an amount of 0.1 mol% per mol% of silver for conversion of the grain surfaces thereby obtain Emulsion I.

Emulsion II

Emulsion II having the same halogen composition and distribution as Emulsion I, but having a mean grain size of 0.26 μm, was prepared in the same manner as Emulsion I, but the amount of ammonia was controlled.

EXAMPLE 1

A coating composition was prepared by adding to Emulsion I a sodium salt of 5,5'-dichloro-9-ethyl-3,3'-bis(3-sulfopropyl)oxacarbocyanine as a sensitizing dye, 4-hydroxy-6-methyl-1,3,3a,7-tetraazaindene as a stabilizer, a dispersion of polyethyl acrylate, polyethylene glycol, 1,3-vinylsulfonyl-2-propanol, Compound I-9 of the present invention and Compound II-63, II-49, II-66, II-72, II-78, II-91, II-92, II-59 or II-86 of the present invention in amounts indicated in Table 1 below, and was coated on a polyethylene terephthalate film to a silver coverage of 3.5 g/m$^2$, followed by drying. For comparison, a sample containing no compound (II) and samples containing unblocked development restrainers (Comparative Compound a, b or a') are prepared. Each of the resulting samples was exposed to light and developed and determined for the photographic characteristics.

The results obtained are shown in Table 1.

TABLE 1

| Sample No. | Emulsion Used | Amount of Compound I-9 (mol/mol-Ag) | Development Restrainer | Amount of Development Restrainer (mol/mol-Ag) | Photographic Property: Relative Sensitivity* | Photographic Property: Gamma | Black Spot** |
|---|---|---|---|---|---|---|---|
| 1 | I | $3 \times 10^{-3}$ | — | — | 100 | 16 | 2 |
| 2 | " | " | II-63 | $5.4 \times 10^{-4}$ | 95 | 16.5 | 3.5 |
| 3 | " | " | " | $1.1 \times 10^{-3}$ | 81 | 13 | 4.5 |
| 4 | " | $3.3 \times 10^{-3}$ | " | " | 93 | 15.5 | 4 |
| 5 | " | $3 \times 10^{-3}$ | II-49 | $2.4 \times 10^{-4}$ | 98 | 16 | 3.5 |
| 6 | " | " | " | $4.8 \times 10^{-4}$ | 95 | 17 | 4 |
| 7 | " | $3.3 \times 10^{-3}$ | " | " | 102 | 16.5 | 3.5 |
| 8 | " | $3 \times 10^{-3}$ | a*** | $5.4 \times 10^{-4}$ | 85 | 11.3 | 4 |
| 9 | " | " | " | $1.1 \times 10^{-3}$ | 69 | 10.6 | 5 |
| 10 | " | " | b*** | $2.4 \times 10^{-4}$ | 93 | 14 | 3.5 |
| 11 | " | " | " | $4.8 \times 10^{-4}$ | 85 | 11 | 4 |
| 34 | I | $3 \times 10^{-3}$ | II-66 | $5.4 \times 10^{-4}$ | 91 | 15.8 | 4.0 |
| 35 | " | " | " | $1.1 \times 10^{-3}$ | 80 | 12.3 | 5.0 |
| 36 | " | $3.3 \times 10^{-3}$ | " | " | 90 | 14.7 | 4.5 |
| 37 | " | $3 \times 10^{-3}$ | II-72 | $5.4 \times 10^{-4}$ | 97 | 17.9 | 3.5 |
| 38 | " | " | " | $1.1 \times 10^{-3}$ | 87 | 15.2 | 4.5 |
| 39 | " | $3.3 \times 10^{-3}$ | " | " | 95 | 17.0 | 4.0 |
| 40 | " | $3 \times 10^{-3}$ | II-78 | $5.4 \times 10^{-4}$ | 94 | 16.3 | 3.5 |
| 41 | " | " | " | $1.1 \times 10^{-3}$ | 80 | 12.4 | 5.0 |
| 42 | " | $3.3 \times 10^{-3}$ | " | " | 91 | 15.1 | 4.5 |
| 43 | " | $3 \times 10^{-3}$ | II-91 | $5.4 \times 10^{-4}$ | 93 | 16.3 | 3.5 |
| 44 | " | " | " | $1.1 \times 10^{-3}$ | 80 | 12.8 | 4.5 |
| 45 | I | $3.3 \times 10^{-3}$ | II-91 | $1.1 \times 10^{-3}$ | 90 | 15.0 | 4.0 |
| 46 | " | $3 \times 10^{-3}$ | II-92 | $5.4 \times 10^{-4}$ | 90 | 15.6 | 4.0 |
| 47 | " | " | " | $1.1 \times 10^{-3}$ | 78 | 12.0 | 5.0 |
| 48 | " | $3.3 \times 10^{-3}$ | " | " | 88 | 14.4 | 4.5 |
| 49 | " | $3 \times 10^{-3}$ | II-59 | $2.4 \times 10^{4}$ | 99 | 18.0 | 3.5 |
| 50 | " | " | " | $4.8 \times 10^{-4}$ | 97 | 17.8 | 4.0 |
| 51 | " | $3.3 \times 10^{-3}$ | " | " | 105 | 17.0 | 3.5 |
| 52 | " | $3 \times 10^{-3}$ | II-86 | $2.4 \times 10^{-4}$ | 97 | 15.9 | 3.5 |
| 53 | " | " | " | $4.8 \times 10^{-4}$ | 94 | 16.8 | 4.0 |
| 54 | " | $3.3 \times 10^{-3}$ | " | " | 101 | 16.7 | 3.5 |
| 55 | " | $3 \times 10^{-3}$ | a'***** | $5.4 \times 10^{-4}$ | 81 | 10.3 | 4.0 |
| 56 | " | " | a'***** | $1.1 \times 10^{-3}$ | 55 | 9.2 | 5.0 |

Note:

*Relative Sensitivity is the relative value of the reciprocal of exposure providing a density of 1.5 by development at 38° C. for 30 seconds. The sensitivity of Sample No. 1 was taken as 100 (standard).

**Black Spots were microscopically observed and evaluated according to five grades. The grade "5" means the best quality, and the grade "1" means the worst. The quality graded "5" or "4" is of practical use; quality graded "3" is poor and is the practically useful lower limit; and quality graded "2" or "1" is of no practical use. A quality between "3" and "4" or between "4" and "5" was evaluated as "3.5" or "4.5", respectively. The evaluation of black spots was made when development was conducted at 38° C. for 30 seconds with a developer having a pH value increased to 11.8 due to fatigue.

***Comparative Compound a

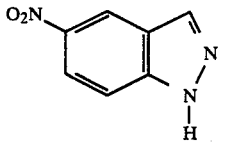

****Comparative Comound b

TABLE 1-continued

| Sample No. | Emulsion Used | Amount of Compound I-9 (mol/mol-Ag) | Development Restrainer | Amount of Development Restrainer (mol/mol-Ag) | Photographic Property Relative Sensitivity* | Gamma | Black Spot** |
|---|---|---|---|---|---|---|---|

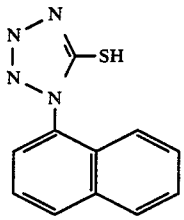

*****Comparative Compound a'

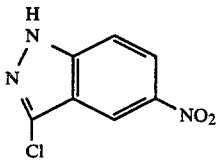

As can be seen from Table 1, Sample Nos. 2 to 7 and 34 to 54 in accordance with the present invention had remarkably fewer black spots, high sensitivity and high contrast, as compared with Comparative Sample Nos. 8 to 11, 55 and 56.

EXAMPLE 2

A coating composition was prepared by adding the same additives as used in Example 1 to Emulsion II, except that Compound I-9 was replaced with Compound I-25 and Compound II-65, II-12, II-17, II-43, II-90 or II-76 was used as compound (II), and was coated on a polyethylene terephthalate film to a silver coverage of 3.3 g/m$^2$, followed by drying. For comparison, a sample containing no compound (II) and a sample containing an unblocked development restrainer (Comparative Compound c or c') were prepared. Each of the resulting samples was exposed to light and developed and then the photographic characteristics were determined in the same manner as described in Example 1.

The results obtained are shown in Table 2.

TABLE 2

| Sample No. | Emulsion Used | Amount of Compound I-25 (mol/mol-Ag) | Development Restrainer | Amount of Development Restrainer (mol/mol-Ag) | Photographic Property Relative Sensitivity | Gamma | Black Spot |
|---|---|---|---|---|---|---|---|
| 12 | II | $2 \times 10^{-4}$ | — | — | 100 | 15 | 1 |
| 13 | " | " | II-65 | $2.8 \times 10^{-4}$ | 93 | 14 | 4 |
| 14 | " | $2.2 \times 10^{-4}$ | " | " | 100 | 15 | 3.5 |
| 15 | " | $2 \times 10^{-4}$ | " | $4.2 \times 10^{-4}$ | 91 | 13 | 4.5 |
| 16 | " | $2.4 \times 10^{-4}$ | " | " | 95 | 15 | 4 |
| 17 | " | $2 \times 10^{-4}$ | c* | $1.43 \times 10^{-4}$ | 91 | 13 | 3.0 |
| 18 | " | $2.2 \times 10^{-4}$ | " | " | 95 | 15 | 2 |
| 19 | " | $2 \times 10^{-4}$ | " | $2.8 \times 10^{-4}$ | 85 | 11 | 4 |
| 20 | " | $2.2 \times 10^{-4}$ | " | " | 91 | 13 | 3.5 |
| 57 | " | $2 \times 10^{-4}$ | II-12 | $2.8 \times 10^{-4}$ | 90 | 12.5 | 4 |
| 58 | " | $2.2 \times 10^{-4}$ | " | " | 97 | 15.0 | 3.5 |
| 59 | " | $2 \times 10^{-4}$ | " | $4.2 \times 10^{-4}$ | 88 | 12.7 | 4.5 |
| 60 | " | $2.2 \times 10^{-4}$ | " | " | 94 | 14.6 | 4 |
| 61 | " | $2 \times 10^{-4}$ | II-17 | $2.8 \times 10^{-4}$ | 87 | 12.0 | 4.5 |
| 62 | " | $2.2 \times 10^{-4}$ | " | " | 95 | 14.6 | 3 |
| 63 | " | $2 \times 10^{-4}$ | " | $4.2 \times 10^{-4}$ | 85 | 12.3 | 5.0 |
| 64 | " | $2.2 \times 10^{-4}$ | " | " | 91 | 14.4 | 4.5 |
| 65 | " | $2 \times 10^{-4}$ | II-43 | $2.8 \times 10^{-4}$ | 95 | 14.6 | 4.0 |
| 66 | " | $2.2 \times 10^{-4}$ | " | " | 101 | 16.0 | 3.5 |
| 67 | " | $2 \times 10^{-4}$ | " | $4.2 \times 10^{-4}$ | 90 | 13.1 | 4.5 |
| 68 | " | $2.2 \times 10^{-4}$ | " | " | 98 | 15.3 | 4 |
| 69 | " | $2 \times 10^{-4}$ | II-90 | $2.8 \times 10^{-4}$ | 91 | 13.8 | 4 |
| 70 | " | $2.2 \times 10^{-4}$ | " | " | 97 | 14.7 | 3.5 |
| 71 | " | $2 \times 10^{-4}$ | " | $4.2 \times 10^{-4}$ | 89 | 12.6 | 4.5 |
| 72 | " | $2.2 \times 10^{-4}$ | " | " | 94 | 14.8 | 4 |
| 73 | " | $2 \times 10^{-4}$ | II-76 | $2.8 \times 10^{-4}$ | 89 | 13.5 | 4.5 |
| 74 | " | $2.2 \times 10^{-4}$ | " | " | 96 | 14.2 | 3.0 |
| 75 | " | $2 \times 10^{-4}$ | " | $4.2 \times 10^{-4}$ | 87 | 12.3 | 5.0 |
| 76 | " | $2.2 \times 10^{-4}$ | " | " | 92 | 14.6 | 4.5 |
| 77 | " | $2 \times 10^{-4}$ | c'** | $1.43 \times 10^{-4}$ | 86 | 11.8 | 3.0 |
| 78 | " | $2.2 \times 10^{-4}$ | " | " | 91 | 14.2 | 2.0 |
| 79 | " | $2 \times 10^{-4}$ | " | $2.8 \times 10^{-4}$ | 81 | 10.1 | 4.0 |

TABLE 2-continued

| Sample No. | Emulsion Used | Amount of Compound I-25 (mol/mol-Ag) | Development Restrainer | Amount of Development Restrainer (mol/mol-Ag) | Photographic Property Relative Sensitivity | Gamma | Black Spot |
|---|---|---|---|---|---|---|---|
| 80 | " | $2.2 \times 10^{-4}$ | " | " | 86 | 12.2 | 3.5 |

Note:
*Comparative Compound c:

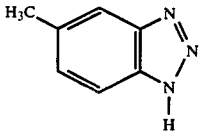

**Comparative Compound c':

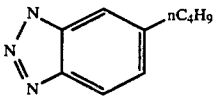

It can be seen from Table 2 that Sample Nos. 13 to 16 and 57 to 76 in accordance with the present invention exhibit the effects of the remarkably improved inhibitory effects of the present invention on black spots, while undergoing less reduction in sensitivity and gamma, as compared with Comparative Sample Nos. 17 to 20 and 77 to 80.

EXAMPLE 3

A coating composition was prepared from Emulsion I or II and the same additives as used in Example 1, except Compound II-86 or II-91 was used as compound (II) of the present invention as shown in Table 3 below. The resulting coating composition was coated on a polyethylene terephthalate film to a silver coverage of 3.5 g/m$^2$. For comparison, samples containing no compound (II) and samples containing unblocked development restrainers (Comparative Compounds a and b described above) were prepared. Each of the resulting samples was exposed to light and developed and then the photographic characteristics were determined in the same manner as in Example 1.

The results obtained are shown in Table 3.

TABLE 3

| Sample No. | Emulsion Used | Amount of Compound I-9 (mol/mol-Ag) | Development Restrainer | Amount of Development Restrainer (mol/mol-Ag) | Photographic Property Relative Sensitivity | Gamma | Black Spot |
|---|---|---|---|---|---|---|---|
| 21 | I | $3 \times 10^{-4}$ | — | — | 100 | 16 | 1 |
| 22 | II | " | — | — | 83 | 14 | 2.5 |
| 23 | " | $3.3 \times 10^{-4}$ | — | — | 89 | 16.5 | 1 |
| 24 | I | $3 \times 10^{-4}$ | II-86 | $4.8 \times 10^{-4}$ | 89 | 14 | 4.5 |
| 25 | " | " | " | $5.2 \times 10^{-4}$ | 83 | 13.5 | 5 |
| 26 | " | $3.6 \times 10^{-4}$ | " | " | 95 | 16 | 4 |
| 27 | " | $3 \times 10^{-4}$ | II-91 | $5.4 \times 10^{-4}$ | 91 | 15.5 | 4 |
| 28 | " | " | " | $1.1 \times 10^{-3}$ | 79 | 13 | 5 |
| 29 | " | $3.6 \times 10^{-4}$ | " | " | 93 | 15.0 | 4 |
| 30 | " | $3 \times 10^{-4}$ | b | $2.4 \times 10^{-4}$ | 93 | 11.3 | 4 |
| 31 | " | " | " | $4.8 \times 10^{-4}$ | 85 | 10.6 | 4.5 |
| 32 | " | " | a | $5.4 \times 10^{-4}$ | 85 | 14 | 3.5 |
| 33 | " | " | " | $1.1 \times 10^{-4}$ | 69 | 11 | 4 |

The results in Table 3 show that Sample Nos. 24 to 29 according to the present invention show remarkable improvement with respect to reduction in black spots, with less reduction in sensitivity and gamma, as compared with Comparative Sample Nos. 30 to 33.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one silver halide emulsion layer, wherein said at least one silver halide emulsion layer or another layer of the silver halide photographic material provided on the support contains at least one compound represented by the formula (I):

$$A-\underset{\underset{R_0}{|}}{N}-\underset{\underset{R_1}{|}}{N}-B \qquad (I)$$

wherein A represents an aliphatic group or an aromatic group; B represents a formyl group, an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfinamoyl group, an alkoxysulfonyl group, a thioacyl group, a thiocarbamoyl group or a heterocyclic group; $R_0$ and $R_1$ each represents a hydrogen atom, a substituted or unsubstituted alkylsulfonyl group, a substituted or unsubstituted arylsulfonyl group or a substituted or unsubstituted acyl group, with the proviso that at least one of $R_0$ and $R_1$ is a hydrogen atom; and B, $R_1$ and the nitrogen atom to which B and $R_1$ are bonded may jointly form —N=C<; and at least the compound which is effective to reduce or eliminate black spots without substantially inhibiting the effect of the compound represented by said formula (I) to increase sensitivity and contrast, said compound is represented by the formula (II):

$$C_A—D \quad (II)$$

wherein $C_A$ represents a blocking group capable of releasing a development restrainer or a precursor thereof at the time of processing; and D represents a development restrainer or a precursor thereof that is bonded to $C_A$ via a hetero atom of D.

2. A silver halide photographic material as in claim 1, wherein said at least one compound represented by the formula (II) is selected from the compounds represented by the formula (III):

$$C_A—(X)_{m1}—E \quad (III)$$

wherein $C_A$ is as defined in claim 1; E represents a development restrainer that is bonded to X via a hetero atom of E; X represents a divalent linking group that is bonded to $C_A$ via a hetero atom of X; and $m_1$ represents 0 or 1.

3. A silver halide photographic material as in claim 2, wherein said compounds represented by the formula (III) are compounds represented by the formula (IV), (V) or (VI):

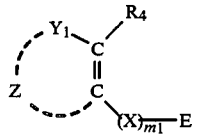

(IV)

wherein E, X and $m_1$ are as defined in claim 2; $R_4$ represents a hydrogen atom or a displaceable group; $Y_1$ represents

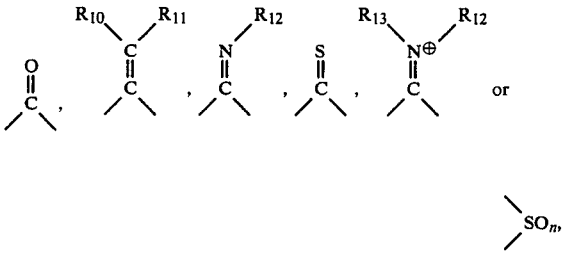

wherein $R_{10}$, $R_{11}$, $R_{12}$ and $R_{13}$ each represents a hydrogen atom or a displaceable group and n represents 1 or 2; and Z represents an atom group necessary to form a carbon ring or a heterocyclic ring;

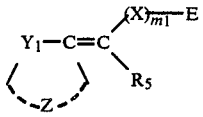

(V)

wherein X, $Y_1$, Z, E and $m_1$ are as defined with respect to formula (IV); and $R_5$ represents a hydrogen atom, a substituted or unsubstituted alkyl group, a substituted or unsubstituted alkenyl group or a substituted or unsubstituted aryl group; or

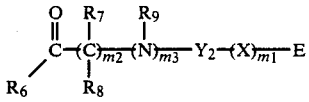

(VI)

wherein X, E and $m_1$ are as defined with respect to formula (IV); $Y_2$ represents

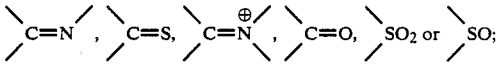

$R_6$ represents a hydrogen atom or a substituent bonded via a carbon atom thereof; $R_7$ and $R_8$, which may be the same or different, each represents a hydrogen atom or a substituent, or $R_7$ and $R_8$ may jointly form a double bond or a ring; $R_9$ represents a hydrogen atom or a substituent; $R_6$, $R_7$, $R_8$ and $R_9$ may be taken together to form a ring as long as the oxygen atom of the carbonyl group is capable of intramolecular nucleophilic attacking on $Y_2$; $m_2$ represents an integer of from 1 to 4; and $m_3$ represents 0 or 1.

4. A silver halide photographic material as in claim 1, wherein said at least one compound represented by the formula (I) is present in an amount of $1\times10^{-6}$ to $1\times10^{-1}$ mol per mol of silver halide and said at least one compound represented by the formula (II) is present in an amount of $5\times10^{-6}$ to 1.0 mol per mol of silver halide.

5. A silver halide photographic material as in claim 1, wherein said at least one compound represented by the formula (I) is present in an amount of $1\times10^{-5}$ to $4\times10^{-1}$ mol per mol of silver halide and said at least one compound represented by the formula (II) is present in an amount of from $1\times10^{-5}$ to $1\times10^{-1}$ mol per mol of silver halide.

6. A silver halide photographic material as in claim 1, wherein:

the aliphatic group represented by A is selected from the group consisting of a t-butyl group, an n-octyl group, t-octyl group, a cyclohexyl group, a pyrrolidyl group, an imidazolyl group, a tetrahydrofuryl group and a morpholino group;

the aromatic group represented by A is selected from the group consisting of a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring; and the heterocyclic group represented by B is a pyrimidine ring, a triazine ring, a pyridine ring, a quinoline ring, a benzimidazole ring, a benzothiazole ring, a benzoxazole ring or an imidazoline ring.

7. A silver halide photographic material as in claim 2, wherein E represents a development restrainer selected from the group consisting of mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines and guanines; and X represents a group selected from the groups having the following structure wherein (E) shows the position wherein X is bonded to E:

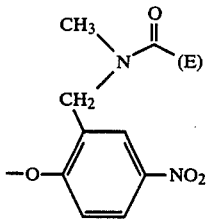

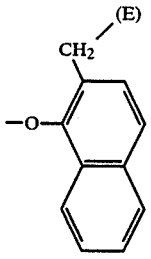

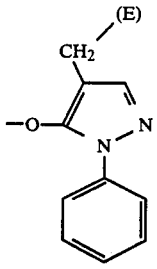

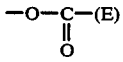

$-OCH_2-(E)$

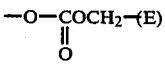

8. A silver halide photographic material as in claim 3, wherein:

E represents a development restrainer selected from the group consisting of mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines and guanines;

$R_4$, $R_{10}$, $R_{11}$, $R_{12}$ and $R_{13}$ each represents a hydrogen atom or a displaceable group selected from the group consisting of a halogen atom, an alkyl group, an alkenyl group, an aryl group, an alkoxy group, an aryloxy group, an alkylthio group, an arylthio group, an acyloxy group, a carbonic acid ester group, an amino group, a carbonamido group, an ureido group, a carboxyl group, a hydroxylcarbonyl group, a carbamoyl group, an acyl group, a sulfo group, a sulfonyl group, a sulfinyl group, a sulfamoyl group, a cyano group and a nitro group;

$R_6$ is a hydrogen atom, an alkyl group, an alkenyl group, an aryl group, a cycloalkyl group or a heterocyclic residue;

$R_7$ and $R_8$, which may be the same or different, each represents a hydrogen atom, a halogen atom, a substituted or unsubstituted alkyl group, a substituted or unsubstituted alkenyl group, a substituted or unsubstituted phenyl group, a hydroxyl group, a substituted or unsubstituted alkoxy group, or a substituted or unsubstituted acyl group, and $R_7$ and $R_8$ may be bonded via a double bond or form a ring;

$R_9$ represents an alkyl group, an alkenyl group or a phenyl group; and the carbon ring or heterocyclic ring represented by:

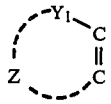

is a 5- or 7-membered heterocyclic ring containing at least one hetero atom selected from the group consisting of a nitrogen atom, an oxygen atom and a sulfur atom.

9. A silver halide photographic material as in claim 3, wherein said carbon ring or heterocyclic ring represented by:

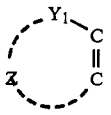

is selected from the group consisting of cyclopentenone, cyclohexenone, cycloheptenone, benzocycloheptenone, benzocyclopentanone, benzocyclohexanone, 4-pyridone, 4-quinolone, 2-pyrrone, 4-pyrrone, 1-thio-2-pyrrone, 1-thio-4-pyrrone, coumarin, chromone, uracil and the heterocyclic rings having the following formula:

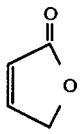

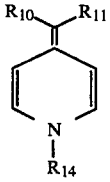

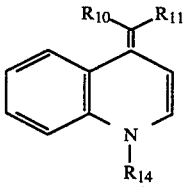

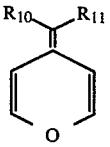

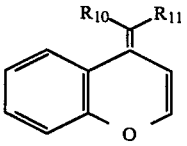

-continued

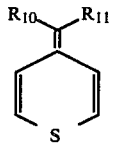

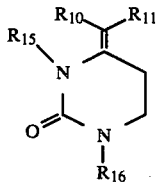

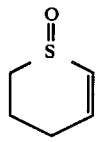

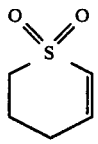

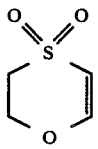

wherein $R_{10}$ and $R_{11}$ are defined in claim 3; $R_{14}$ represents a hydrogen atom or a substituent; $R_{15}$ and $R_{16}$ each represents a hydrogen atom, an alkyl group, an alkenyl group, an aryl group, a carbamoyl group, a hydroxycarbonyl group, an acyl group, a sulfonyl group, a sulfinyl group or a sulfamoyl group; and wherein said carbon ring or heterocyclic ring represented by:

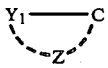

is selected from the group consisting of cyclopentanone, cyclohexanone, cycloheptanone, benzocycloheptanone, benzocyclopentanone, benzocyclohexanone, 4-tetrahydropyridone, 4-dihydroquinone and 4-tetrahydropyrrone.

10. A silver halide photographic material as in claim 1, wherein said at least one compound represented by the formula (I) and said at least one compound represented by the formula (II), which may be in the same layer or in different layers, are incorporated in a silver halide emulsion layer, a protective layer, an intermediate layer, a filter layer, or an antihalation layer.

11. A process for forming a super-high contrast negative image, comprising imagewise exposing and developing a silver halide photographic material comprising a support having provided thereon at least one silver halide emulsion layer, said emulsion layer or another layer containing at least one compound represented by the formula (I):

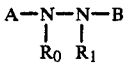

(I)

wherein A represents an aliphatic group or an aromatic group; B represents a formyl group, an acyl group, an alkylsulfonyl group, an arylsulfonyl group, an alkylsulfinyl group, an arylsulfinyl group, a carbamoyl group, an alkoxycarbonyl group, an aryloxycarbonyl group, a sulfinamoyl group, an alkoxysulfonyl group, a thioacyl group, a thiocarbamoyl group or a heterocyclic group; $R_0$ and $R_1$ each represents a hydrogen atom, a substituted or unsubstituted alkylsulfonyl group, a substituted or unsubstituted arylsulfonyl group or a substituted or unsubstituted acyl group, with the proviso that at least one of $R_0$ and $R_1$ is a hydrogen atom; and B, $R_1$ and the nitrogen atom to which B and $R_1$ are bonded may jointly form —N=C<; and at least one compound represented by the formula (II):

$$C_A—D \qquad (II).$$

wherein $C_A$ represents a blocking group capable of releasing a development restrainer or a precursor thereof at the time of processing; and D represents a development restrainer or a precursor thereof that is bonded to $C_A$ via a hetero atom of D, and developing the exposed material with a developer containing not less than 0.15 mol/l of a sulfite ion and having a pH of from 10.5 to 12.3.

12. A process for forming a super-high contrast negative image as claimed in claim 11, wherein said developing is carried out with a developer containing a sulfite ion in an amount of from 0.4 mol/l to 2.5 mol/l and having a pH of 10.5 to 12.3.

* * * * *